US011345177B2

(12) United States Patent
Shinoda et al.

(10) Patent No.: US 11,345,177 B2
(45) Date of Patent: May 31, 2022

(54) PRETREATMENT APPARATUS

(71) Applicant: BROTHER KOGYO KABUSHIKI KAISHA, Nagoya (JP)

(72) Inventors: Akira Shinoda, Obu (JP); Shuichi Tamaki, Nagoya (JP); Stephen McGavin Harpold, Grand Rapids, MI (US); Hans Peter Broeckert, Grand Rapids, MI (US)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/730,443

(22) Filed: Dec. 30, 2019

(65) Prior Publication Data

US 2021/0197604 A1 Jul. 1, 2021

(51) Int. Cl.
*B41M 5/00* (2006.01)

(52) U.S. Cl.
CPC ..... *B41M 5/0011* (2013.01)

(58) Field of Classification Search
CPC ..... B41M 5/0011; B41F 15/12; B41F 16/02; B41F 19/00; B41J 3/4078; B41J 11/0015; D06B 11/0059
See application file for complete search history.

(56) References Cited

FOREIGN PATENT DOCUMENTS

JP 2017-148970 A 8/2017

*Primary Examiner* — Lamson D Nguyen
(74) *Attorney, Agent, or Firm* — K&L Gates LLP

(57) ABSTRACT

The present disclosure relates to a pretreatment device capable of increasing a number of media on which a pretreatment can be performed within a fixed period. The pretreatment device includes a platen, a pretreatment portion configured to perform the pretreatment on a medium set on the platen, and a belt configured to convey the platen from a set position to the set position via the pretreatment portion. The medium is placed on the platen at the set position. Thus, since the belt conveys the platen on which the medium is set, the pretreatment device is able to perform the pretreatment on a plurality of the media within the fixed period.

17 Claims, 15 Drawing Sheets

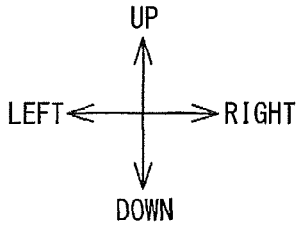
FIG. 13A
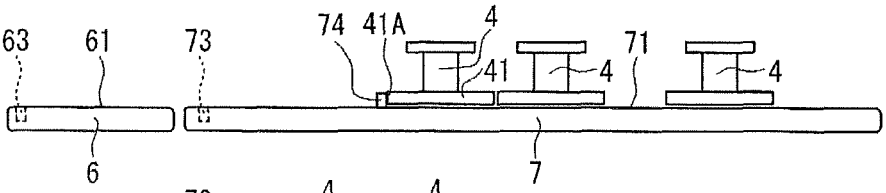
FIG. 13B
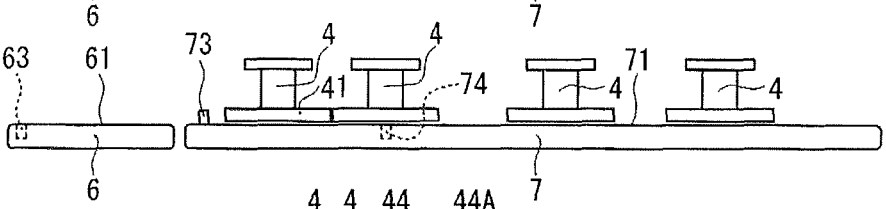
FIG. 13C
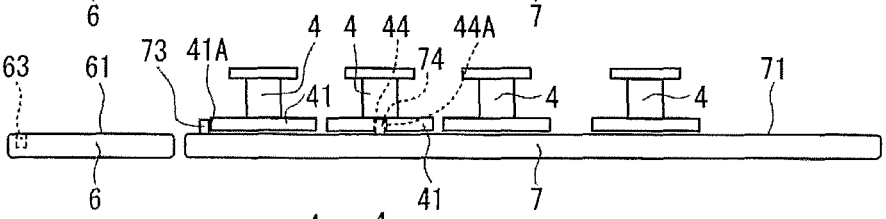
FIG. 13D
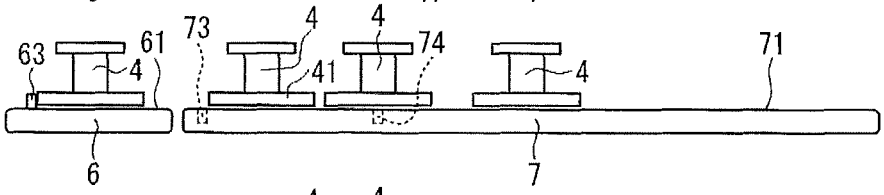
FIG. 13E
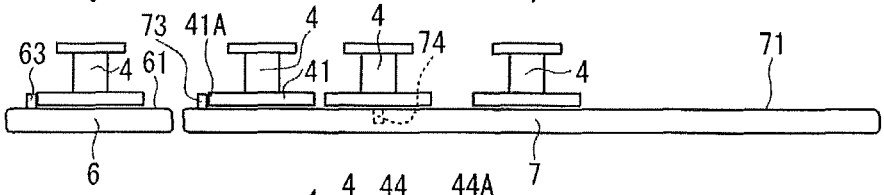
FIG. 13F
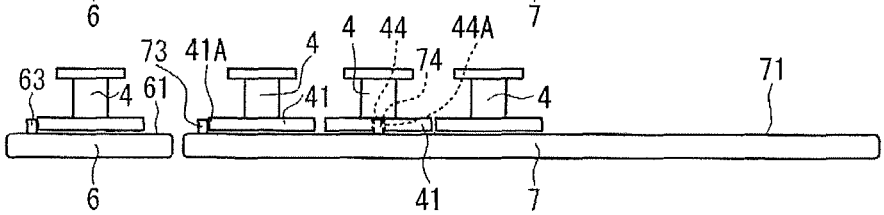

PRETREATMENT APPARATUS

BACKGROUND

The present disclosure relates to a pretreatment apparatus.

A printing apparatus is known that performs printing processing on a recording medium, such as a fabric or the like. The printing apparatus is provided with a platen including a support surface capable of supporting the medium, and a printing portion that performs printing on the recording medium supported by the platen. Before the printing on the medium by the printing apparatus, for example, there is a case in which a pretreatment agent is applied to the recording medium, and heat processing is performed on the recording medium to which the pretreatment agent has been applied.

SUMMARY

In general, in order to print only on a predetermined section of the recording medium, such as a front surface of a T-shirt or the like, in the printing apparatus, preferably only the predetermined section of the recording medium is disposed on a top surface of the platen. Further, before the printing on the recoding medium by the printing apparatus, pretreatment is performed on the predetermined section of the recording medium. For example, a pretreatment agent is applied to the predetermined section of the recording medium and heat processing is performed. When the pretreatment is performed on a plurality of fabrics, as the recording medium, in a fixed period, it is conceivable to convey the fabric to a pretreatment portion using belt conveyance. However, if the fabric is simply placed on the belt, it is difficult to perform the pretreatment only on the predetermined section of the fabric. In printing on a recording medium other than the fabric also, it is preferable to fix the recording media, and perform the pretreatment on the recording medium. In this case also, if the recording medium is simply placed on the belt, there is a problem that it is difficult to perform the pretreatment on the predetermined section of the recording medium only.

Embodiments of the broad principles derived herein provide a pretreatment apparatus capable of increasing a number of media on which pretreatment is performed in a fixed period.

A pretreatment apparatus according to a first aspect of the present disclosure includes: a platen, a pretreatment portion configured to perform a pretreatment on a medium set on the platen, and a belt configured to convey the platen from a set position to the set position via the pretreatment portion. The medium is placed on the platen at the set position.

In the pretreatment apparatus according to a first aspect, since the platen on which the medium is placed is conveyed by the belt, the pretreatment apparatus is able to perform the pretreatment on a plurality of the media within the fixed period.

In the pretreatment apparatus according to a first aspect, since the platen on which the medium is placed is conveyed by the belt, the pretreatment apparatus is able to perform the pretreatment on a plurality of the media within the fixed period.

Further, the belt may include a staying area where the platen that has finished processing in the pretreatment portion is caused to stay, and the belt may convey the platen in the staying area to the set position, after the platen on which the medium is placed at the set position is conveyed toward the pretreatment portion. In this case, since the platen at the staying area is conveyed toward the set position after the platen on which the medium is placed at the set position is conveyed toward the pretreatment portion, it can be reduced to occur inefficiencies such as conveying an empty platen.

Further, the belt may include a set position belt and a staying area belt, and the staying area belt may convey the platen toward the set position after the set position belt conveys the platen. In this case, more reliably, it is possible to prevent the platen from being conveyed from the staying area during setting the medium to the platen.

Further, the pretreatment apparatus may further include: a stopper configured to restrict the platen in the staying area from being conveyed toward the set position, and the stopper configured to protrude upward from the belt between the set position and the staying area. The belt may be configured to convey the platen toward the pretreatment portion, and the stopper may releases restriction of the platen in the staying area after the platen in the set position is conveyed toward the pretreatment portion. In this case, it is possible to prevent the platen from being conveyed from the staying area during setting the medium to the platen.

Further, in the pretreatment apparatus, the stopper may include a first stopper and a second stopper, the first stopper and the second stopper may be arranged with an interval therebetween longer than a length of the platen in a conveying direction of the platen, the second stopper may be configured to restrict the platen in the staying area from being conveyed toward the set position, and the first stopper may be configured to restrict the conveying of the platen in the staying area. In this case, it is possible to keep appropriate interval between two platens when the two platens are on the staying on the belt.

Further, the pretreatment apparatus may further include: a processor; and a memory storing computer-readable instructions that, when executed by the processor, cause the processor to perform processes including: raising the first stopper, when the belt conveys the platen after raising the second stopper. In this case, an interval between the platens is maintained, and one platen can be reliably sent to the set position.

Further, the pretreatment apparatus may further include: a receiver configured to receive an instruction to start conveying the platen at the set position toward the pretreatment portion. The belt may convey the platen at the set position when the receiver receives the instruction. In this case, the belt can convey the platen at the set position when the receiver receives the instruction.

Further, the staying area may include a first staying area and a second staying area, the second staying area may be adjacent to the first staying area and receive the platen from a previous process, and the pretreatment apparatus may further include: a processor; and a memory storing computer-readable instructions that, when executed by the processor, cause the processor to perform processes including: determining whether there is an empty space for the platen to stay in the first staying area; and conveying the platen from the second staying area to the first staying area when it is determined that there is the empty space in the first staying area. In this case, it can be reduced to convey the platen to the first staying area when there is no empty space in the first staying area.

Further, the pretreatment apparatus may further include: a processor; and a memory storing computer-readable instructions that, when executed by the processor, cause the processor to perform processes including: cause the processor to perform processes including: determining whether an error command has been received; and executing error processing when it is determined that the error command has been received. In this case, the error processing can be executed when the error is occurred.

Further, the pretreatment portion may include a heat processing portion, and the memory may further store computer-readable instructions that, when executed by the processor, cause the processor to perform processes including: determining whether the platen is to be caused to stay in the second staying area; and causing the platen to stay in the second staying area for a certain period of time so as to cool the platen, when it is determined that the platen is to be caused to stay in the second staying area. In this case, the platen can be cooled before reaching the set position.

Further, the pretreatment apparatus may further include: a set position sensor configured to detect the platen at the set position; and a staying area sensor configured to detect the platen in the staying area. The belt may convey the platen from the staying area to the set position when a state changes from a state of detecting the platen by the set position sensor to a state of not detecting the platen by the set position sensor. In this case, the work burden on an operator from finishing setting medium to the platen to setting medium to the next platen can be reduced.

Further, the pretreatment apparatus may further include: a platen fixing portion configured to fix the platen at the set position. In this case, the operator can set the medium on the platen in the state of the platen is fixed by the platen fixing portions.

Further, the pretreatment portion may include an application portion and a heat processing portion, the application portion may be configured to apply a pretreatment agent to a fabric set on the platen, and the heat processing portion may be configured to perform heat processing on the fabric set on the platen. In this case, the application portion may apply the pretreatment agent to the fabric set on the platen, and the heat processing portion may perform heat processing on the fabric set on the platen.

Further, the pretreatment portion may include a heat press portion. The heat press portion may include: an air passage member defining a passage for air; an air supply source connected to the air passage member; a first valve connected downstream of the air supply source via the air passage member, the first valve being configured to be switchable between an open state and a closed state; a second valve connected downstream of the first valve via the air passage member, the second valve being configured to be switchable between the open state and the closed state; an air cylinder connected downstream of the second valve via the air passage member; and a third valve connected downstream of the air cylinder via the air passage member, the third valve being configured to be switchable between the open state and the closed state. In this case, by virtue of the second valve, it is possible to independently control air pressure in an air chamber, which is defined by the air passage member between the first valve and the second valve, and an air cylinder chamber which is defined by the air passage member between the second valve and the air cylinder, the air cylinder, and the air passage member between the air cylinder and the third valve. Therefore, it is possible to prepare compressed air in the air chamber for the next heat pressing at a pressure different from that of the ongoing heat pressing.

Further, the heat press portion may further include a pressure transducer connected to the air passage member between the first valve and the second valve, the pressure transducer being configured to output a pressure signal corresponding to air pressure in the air passage member between the first valve and the second valve. The pretreatment apparatus may further include: a processor; and a memory storing computer-readable instructions that, when executed by the processor, cause the processor to perform processes including: controlling, when the first valve, the second valve, and the third valve are in the closed state, the first valve to be in the open state; monitoring the pressure signal from the pressure transducer; and controlling, in response to receiving the pressure signal indicating a predetermined pressure, the first valve to be in the closed state. In this case, it is possible to prepare compressed air at a desired pressure even if the air supply source provides compressed air at a fixed pressure.

Further, the heat press portion may further include a downstream sensor located downstream of the air cylinder in a conveying path of the platen, the downstream sensor being configured to detect the platen. The memory may further store computer-readable instructions that, when executed by the processor, cause the processor to perform processes including: controlling, in response to receiving a detection signal from the downstream sensor, the second valve to be in the open state. In this case, since the second valve is opened in response to the detection signal from the downstream sensor, it is possible to reduce a risk where the second valve is opened when the platen has not been located at a position where heat pressing is to be performed.

Further, the memory may further store computer-readable instructions that, when executed by the processor, cause the processor to perform processes including: controlling, after controlling the second valve to be in the open state, the second valve to be in the closed state; and controlling the first valve to be in the open state after controlling the second valve to be in the closed state. In this case, it is possible to prepare the compressed air for the next heat pressing during the ongoing heat pressing.

BRIEF DESCRIPTION OF THE DRAWINGS

FIG. 13A to FIG. 13F are views showing operations of a stopper 73 and a stopper 74.

DETAILED DESCRIPTION

A pretreatment apparatus 1 according to a first embodiment of the present disclosure will be explained with reference to the drawings. The upper left side, the lower right side, the front left side, the rear right side, the left side, and the right side in FIG. 1 respectively correspond to an upper side, a lower side, a front side, a rear side, a left side and a right side of the pretreatment apparatus 1.

Configuration of Pretreatment Apparatus 1

Figure 1:
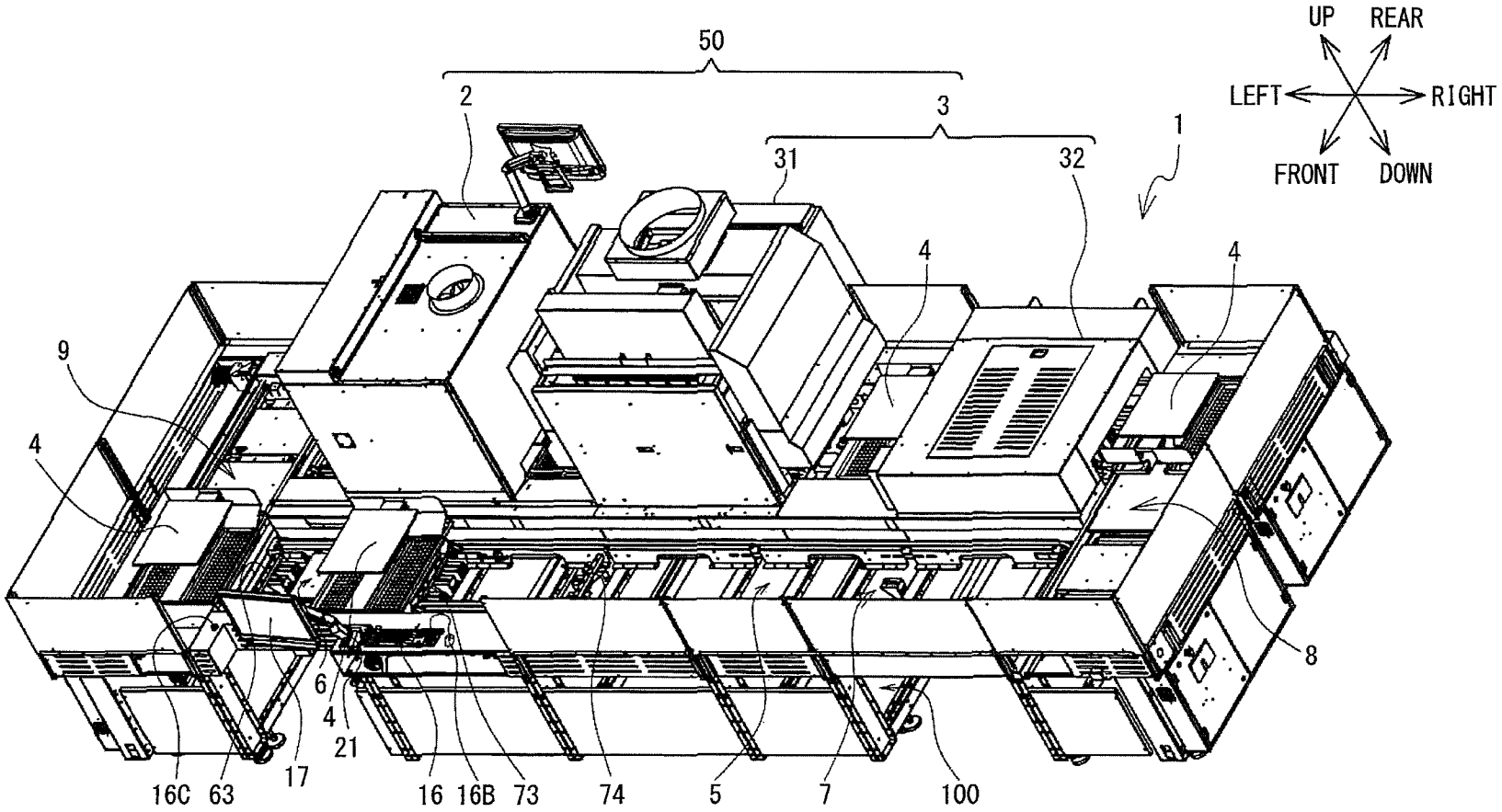
FIG. 1 is a perspective view of a pretreatment apparatus 1.
Figure 2:
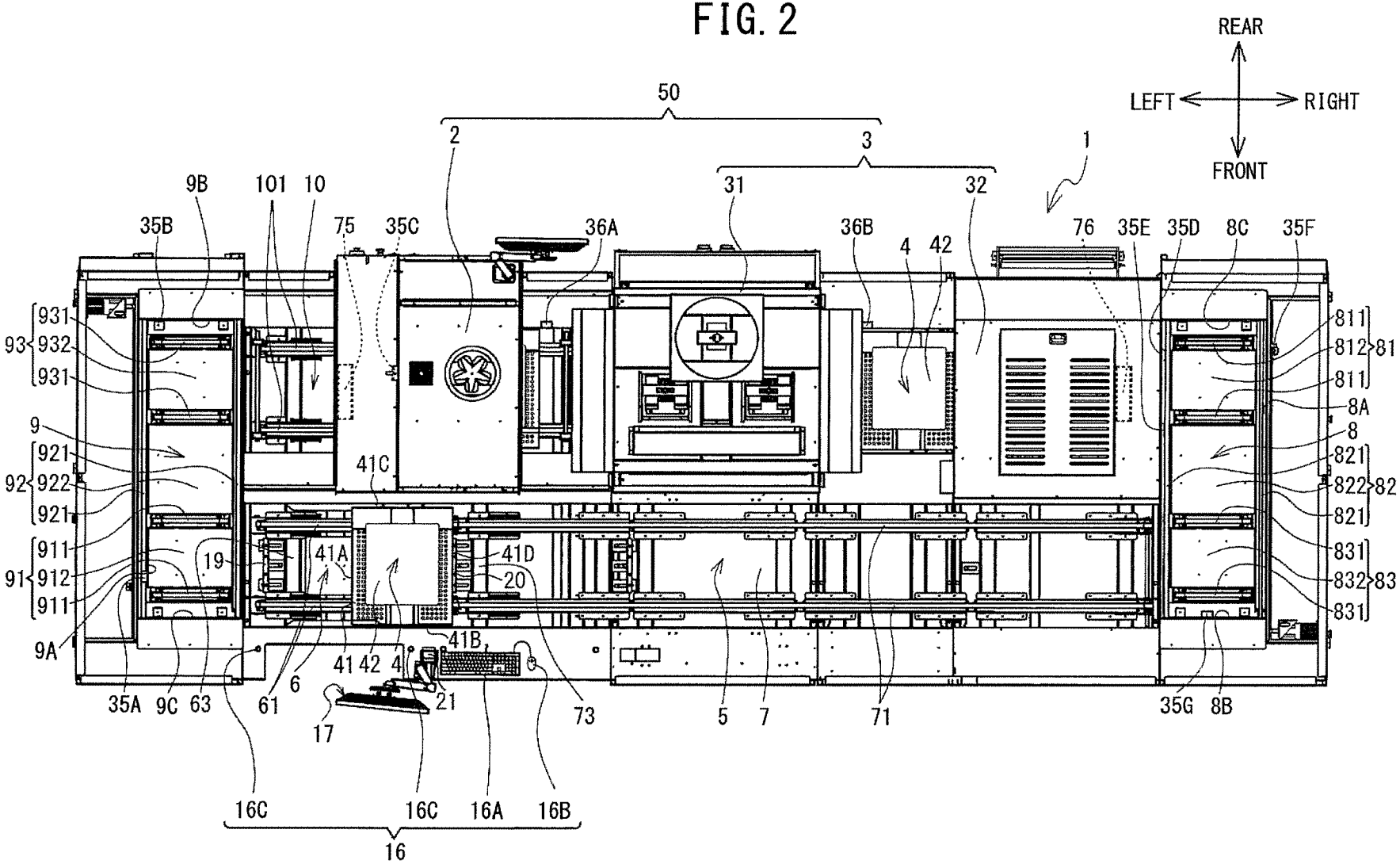
FIG. 2 is a plan view of the pretreatment apparatus 1.

As shown in FIG. 1 and FIG. 2, the pretreatment apparatus 1 is provided with a pretreatment portion 50, a conveying path 5, a platen 4, an operation portion 16, a display portion 17, a code reader 21, and the like, on a frame 100. The frame 100 is a base formed by combining metal frame materials. The pretreatment portion 50 is provided on a rear portion side of the pretreatment device 1, and is provided with an application portion (pretreatment portion) 2 and a heat processing portion (pretreatment portion) 3, from the left. The application portion 2 is, for example, an application device that applies a pretreatment agent to a recording medium, such as a fabric or the like, placed on the platen 4, and the platen 4 can pass through the application portion 2. As an example, the application of the pretreatment agent is performed by ejecting the pretreatment agent from a spray (not shown in the drawings) provided inside the application portion 2. The pretreatment agent is a base coat agent that is applied to the fabric, which is the example of the recording medium, before ink is applied to the fabric. The pretreatment agent is a liquid for forming a film between fibers of the fabric so that the ink will remain more effectively on the fabric, and includes resin components, for example. Further, the pretreatment agent includes, for example, a divalent metal salt ($CaCl_2$), $Ca(NO_2)_2$, or the like), and causes color development of the ink to be brighter.

Figure 6A:
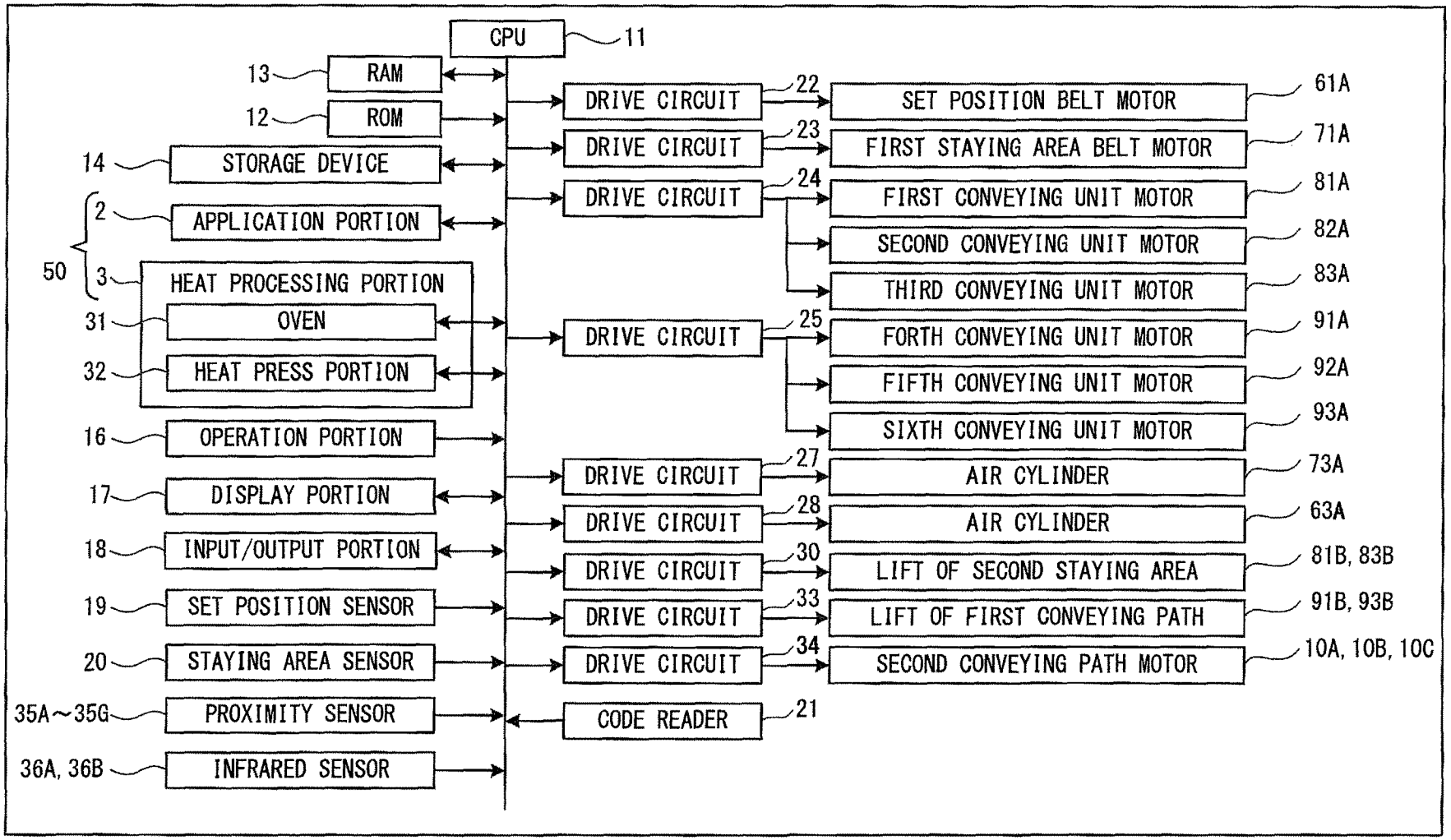
FIG. 6A is a block diagram showing an electrical configuration of the pretreatment apparatus 1.
Figure 6B:
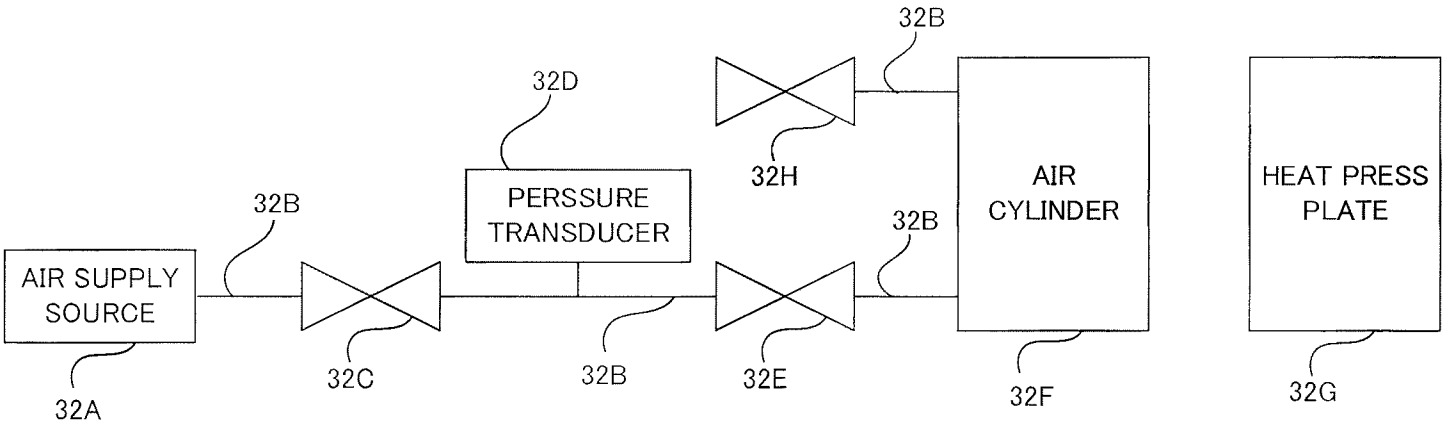
FIG. 6B is a schematic diagram showing a configuration of a heat press portion 32.

The heat processing portion 3 is provided with an oven 31 and a heat press portion 32, from the left to the right. The platen 4 can pass through the oven 31, which is internally provided with a heater (not shown in the drawings). The oven 31 applies heat to the pretreatment agent applied to the recording medium on the platen 4. The platen 4 can pass through the heat press portion 32, which is provided with a heat press plate 32G (FIG. 6B). The heat press plate 32G is provided with a heater (not shown in the drawings). The heat press plate 32G or the platen 4 can be moved in the up-down direction by a raising/lowering mechanism (e.g., an air cylinder 32F in FIG. 6B). The heat press portion 32 performs heating and pressing by causing the heat press plate to come into contact with the recording medium on the platen 4. Specifically, the pretreatment portion 50 may include the application portion 2 and the heat processing portion 3, the application portion 2 may apply the pretreatment agent to the fabric set on the platen 4, and the heat processing portion 3 performs the heat processing on the fabric set on the platen 4.

The conveyance portion 5 is provided with a first staying area 7 and a set position 6 on the front side of the frame 100, a second staying area 8 on the right side of the frame 100, a first conveying path 9 on the left side of the frame 100, and a second conveying path 10 on the rear side of the frame 100. The platen 4 is conveyed from the set position 6 to the set position 6 via the first conveying path 9, the second conveying path 10, the second staying area 8, and the first staying area 7.

As shown in FIG. 2, the set position 6 is provided to the left of the first staying area 7. The set position 6 is a position at which the platen 4 stops and the recording medium is set on the platen 4. The set position 6 is provided with belts 61 that extend in the left-right direction. The belts 61 are stretched between pulleys (not shown in the drawings). The belts 61 are provided at a fixed interval in the front-rear direction, the fixed interval being the same as that for belts 71 to be described later. The belts 61 are rotated in the leftward direction by a set position belt motor 61A (refer to FIG. 6A). A stopper 63 is provided on a left end portion of the set position 6. The stopper 63 is moved in the up-down direction by an air cylinder 63A (refer to FIG. 6A).

The first conveying path 9 is provided on a left end portion side of the pretreatment apparatus 1, is adjacent to the left side of the set position 6, and extends in the front-rear direction. The first conveying path 9 is a conveying path that receives the platen 4 discharged from the set position 6 and feeds the platen 4 to the second conveying path 10. At least a wall surface 9A, a wall surface 9B, and a wall surface 9C are provided around the first conveying path 9. The wall surface 9A is provided to the left of the first conveying path 9, and is a flat surface extending at a constant height in the front-rear direction. The wall surface 9B is provided to the rear of the first conveying path 9, is orthogonal to the wall surface 9A, and is a flat surface extending at a constant height in the left-right direction. The wall surface 9C is provided to the front of the first conveying path 9, is orthogonal to the wall surface 9A, and is a flat surface extending in at a constant height in the left-right direction. Each of upper ends of the wall surface 9A, the wall surface 9B, and the wall surface 9C is higher than each of lower ends of surfaces 41A and 41C provided on the base portion 41 of the platen 4 to be described later when the platen 4 is located on the belts 911, 921, 931 to be described later. Preferably, the height of each of the upper ends of the wall surface 9A, the wall surface 9B, and the wall surface 9C is higher than each of upper ends of surfaces 41A and 41C when the platen 4 is located on the belts 911, 921, 931.

The first conveying path 9 is provided, from the front toward the rear, with a fourth conveying unit 91, a fifth conveying unit 92, and a sixth conveying unit 93. The fourth conveying unit 91 extends in the left-right direction from the set position 6 toward the wall surface 9A, and is configured by a pair of belts 911. Each of the belts 911 extends in the left-right direction, and is stretched between a pair of left and right pulleys (not shown in the drawings). Further, each of the belts 911 is provided with a fixed interval therebetween in the front-rear direction. The fixed interval is shorter than a length, in the front-rear direction, of the base portion 41 of the platen 4, and is a distance allowing the base portion 41 to be mounted on each of the belts 911 while straddling the belts 911. Each of the belts 911 is rotated in the leftward direction by a fourth conveying unit motor 91A (refer to FIG. 6A). Further, each of the belts 911 of the fourth conveying unit 91 is moved in the up-down direction by a lift 91B (refer to FIG. 6A) of the first conveying path 9.

The fifth conveying unit 92 extends from the wall surface 9C side toward the wall surface 9B side, and is configured by a pair of belts 921. Each of the belts 921 extends in the front-rear direction and is stretched between a pair of front and rear pulleys (not shown in the drawings). Further, each of the belts 921 is provided with a fixed interval therebetween in the left-right direction. The fixed interval is shorter than a length, in the left-right direction, of the base portion 41 of the platen 4, and is a distance allowing the base portion 41 to be mounted on each of the belts 921 while straddling the belts 921. Each of the belts 921 is rotated in the rearward direction by a fifth conveying unit motor 92A (refer to FIG. 6A). Further, each of the belts 921 is provided at a position lower than that of the belts 71 to be described later of the first staying area 7.

The sixth conveying unit 93 extends in the left-right direction from the wall surface 9A side toward the second conveying path 10 side, and is configured by a pair of belts 931. Each of the belts 931 extends in the left-right direction, and is stretched between a pair of left and right pulleys (not shown in the drawings). Further, each of the belts 931 is provided with a fixed interval therebetween in the front-rear direction. The fixed interval is shorter than the length, in the front-rear direction, of the base portion 41 of the platen 4, and is a distance allowing the base portion 41 to be mounted on each of the belts 931 while straddling the belts 931. Each of the belts 931 is rotated in the rightward direction by a sixth conveying unit motor 93A (refer to FIG. 6A). Further, each of the belts 931 is moved in the up-down direction by a lift 93B (refer to FIG. 6A) of the first conveying path 9.

A rectangular plate portion 912 is provided between the pair of belts 911. Similarly, a rectangular plate portion 932 is provided between the pair of belts 931. Further, between the pair of belts 921, a rectangular plate portion 922 may be provided, or need not necessarily be provided, between the fourth conveying unit 91 and the sixth conveying unit 93. Note that an end surface 41A (refer to FIG. 4) of the platen 4 being conveyed by the fourth conveying unit 91 comes into contact with the wall surface 9A so that displacement of the base portion 41 of the platen 4 in the left-right direction is corrected. Further, an end surface 41C (refer to FIG. 4) of the platen 4 being conveyed by the sixth conveying unit 93 comes into contact with the wall surface 9B so that displacement of the base portion 41 of the platen 4 in the front-rear direction is corrected. Specifically, when the platen 4 is disposed at the set position 6 or in the process of transporting the platen 4 from the set position 6, each end surfaces 41A and 41C of the platen 4 may be displaced from the front-rear direction and the left-right direction, each of the end surfaces 41A and 41C comes in contact with each of the wall surface 9A and the wall surface 9B, respectively, and each of the end surfaces 41A and 41C are arranged in the front-rear direction and the left-right direction position, respectively. As a result, the pretreatment area in the pretreatment portion 50 and the area to be pretreated on the fabric are likely to coincide.

The second conveying path 10 is provided to the rear of the pretreatment apparatus 1, and extends in the left-right direction from the first conveying path 9 side toward the second staying area 8 side. The second conveying path 10 is provided with a pair of belts 101 that extend in the left-right direction from the first conveying path 9 side, passing through the application portion 2, as far as a left end portion of the oven 31. Each of the belts 101 extends in the left-right direction and is stretched between a pair of left and right pulleys (not shown in the drawings). Each of the belts 101 is rotated in the rightward direction by a second conveying path motor 10A (refer to FIG. 6A). A stopper 75 is provided, in the second conveying path 10, below the application portion 2. The configuration of the stopper 75 is the same as that of the stopper 63. Further, the second conveying path 10 is provided with a heat-resistant net (not shown in the drawings) below the oven 31. This net extends in the left-right direction and is stretched between a pair of left and right pulleys (not shown in the drawings). The net is rotated in the rightward direction by a second conveying path motor 10B (refer to FIG. 6A). Further, the second conveying path 10 is provided with a pair of belts (not shown in the drawings) that extend in the left-right direction from the right side of the oven 31, passing through the heat press portion 32, as far as the left side of the second staying area 8. These belts extend in the left-right direction and are stretched between a pair of left and right pulleys (not shown in the drawings). A stopper 76 is provided, in the second conveying path 10, below the heat press portion 32. The configuration of the stopper 76 is the same as that of the stopper 63. Each of the belts is rotated in the rightward direction by a second conveying path motor 10C (refer to FIG. 6A).

The second staying area 8 is provided on a right end portion of the pretreatment apparatus 1, and extends in the front-rear direction adjacent to right end portions of the heat press portion 32 and the first staying area 7. The second staying area 8 is an area that receives the platen 4 discharged from the heat press portion 32, and feeds the platen 4 to the first staying area 7. At least a wall surface 8A, a wall surface 8B, and a wall surface 8C are provided around the second staying area 8. The wall surface 8A is provided to the right of the second staying area 8, and is a flat surface extending at a constant height in the front-rear direction. The wall surface 8B is provided to the front of the second staying area 8, is orthogonal to the wall surface 8A, and is a flat surface extending at a constant height in the left-right direction. The wall surface 8C is provided to the rear of the second staying area 8, is orthogonal to the wall surface 8A, and is a flat surface extending in at a constant height in the left-right direction. Further, the second staying area 8 is provided, from the rear toward the front, with a first conveying unit 81, a second conveying unit 82, and a third conveying unit 83. The first conveying unit 81 extends in the left-right direction from the heat press portion 32 side toward the wall surface 8A, and is configured by a pair of belts 811. Each of the belts 811 extends in the left-right direction, and is stretched between a pair of left and right pulleys (not shown in the drawings). Each of the belts 811 is provided with a fixed interval therebetween in the front-rear direction. The fixed interval is shorter than the length, in the front-rear direction, of the base portion 41 of the platen 4, and is a distance allowing the base portion 41 to be mounted on each of the belts 811 while straddling the belts 811. Each of the belts 811 of the first conveying unit 81 is driven in the rightward direction by a first conveying unit motor 81A (refer to FIG. 6A). Further, each of the belts 811 of the first conveying unit 81 is moved in the up-down direction by a lift 81B (refer to FIG. 6A) of the second staying area 8.

The second conveying unit 82 extends from the wall surface 8C toward the wall surface 8B, and is configured by a pair of belts 821. Each of the belts 821 extends in the front-rear direction, is stretched in the front-rear direction between pulleys (not shown in the drawings), and is provided with a fixed interval therebetween in the left-right direction. The fixed interval is shorter than the length, in the left-right direction, of the base portion 41 of the platen 4, and is a distance allowing the base portion 41 to be mounted on each of the belts 821 while straddling the belts 821. Each of the belts 821 is rotated in the front direction by a second conveying unit motor 82A (refer to FIG. 6A). Further, each of the belts 821 is provided at a position lower than that of the belts 71 of the first staying area 7.

The third conveying unit 83 extends in the left-right direction from the wall surface 8A toward the first staying area 7, and is configured by a pair of belts 831. Each of the belts 831 extends in the left-right direction, and is stretched in the left-right direction between pulleys (not shown in the drawings). Each of the belts 831 is provided with a fixed interval therebetween. The fixed interval is shorter than the length, in the front-rear direction, of the base portion 41 of the platen 4, and is a distance allowing the base portion 41 to be mounted on each of the belts 831 while straddling the belts 831. Each of the belts 831 is rotated in the leftward direction by a third conveying unit motor 83A (refer to FIG. 6A). Further, each of the belts 831 of the third conveying unit 83 is moved in the up-down direction by a lift 83B (refer to FIG. 6A) of the second staying area 8.

A rectangular plate portion 812 is provided between the pair of belts 811. Similarly, a rectangular plate portion 832 is provided between the pair of belts 831. Further, between the pair of belts 821, a rectangular plate portion 822 may be provided, or need not necessarily be provided, between the first conveying unit 81 and the third conveying unit 83. Note that, for the platen 4 being conveyed by the first conveying unit 81, an inclination with respect to the left-right direction is corrected by the platen 4 coming into contact with the wall surface 8A, and an inclination with respect to the front-rear direction is corrected by the platen 4 coming into contact with the wall surface 8B.

As shown in FIG. 2, the first staying area 7 is provided on the front portion side of the pretreatment apparatus 1, and extends in the left-right direction from the second staying area 8 toward the set position 6. The first staying area 7 is provided with the pair of belts 71 that extend in the left-right direction. The pair of belts 71 are stretched between a pair of left and right pulleys (not shown in the drawings). Each of the belts 71 is provided with a fixed interval therebetween in the front-rear direction. This fixed interval is shorter than the length, in the front-rear direction, of the base portion 41 to be described later of the platen 4, and is a distance allowing the base portion 41 to be mounted on each of the belts 71 while straddling the belts 71. Each of the belts 71 is driven in the leftward direction by a first staying area belt motor 71A (refer to FIG. 6A). The first staying area 7 is an area at which the platen 4 can stay. A stopper 73 is provided at a left end portion of the first staying area 7. The stopper 73 is rod-shaped and extends in the front-rear direction, and is moved in the up-down direction by an air cylinder 73A (refer to FIG. 6A).

As shown in FIG. 2, the operation portion 16, the display portion 17, and the code reader 21 are provided to the front of the set position 6. The operation portion 16 includes, for example, a keyboard 16A, a mouse 16B, and a pair of start switches 16C. Various commands are input from the operation portion 16. When the fixing of the recording medium on the platen 4 is complete at the set position 6, the start switches 16C input a command to start the pretreatment to a CPU (processor, receiver) 11 to be described later, on the basis of an operation by the operator. An example of the display portion 17 is a known display device. Various pieces of information are displayed on the display portion 17. A transparent touch panel is provided on the front surface of the display portion 17, and various commands can be input. An example of the code reader 21 is a bar code reader. The code reader 21 reads a bar code attached to the recording medium. Examples of the bar code include a one-dimensional bar code, a two-dimensional bar code, or the like.

As shown in FIG. 2, a set position sensor 19 is provided at the set position 6, and a staying area sensor 20 is provided on the left end portion of the first staying area 7. The set position sensor 19 and the staying area sensor 20 are proximity sensors, for example. A proximity sensor 35A is provided on the left side of the fourth conveying unit 91 of the first conveying path 9, such as on the wall surface 9A, for example. A proximity sensor 35B is provided on the rear side of the sixth conveying unit 93, such as on the wall surface 9B, for example. A proximity sensor 35C is provided on a left end portion of the application portion 2. An infrared sensor 36A is provided between the application portion 2 and the oven 31, and an infrared sensor 36B is provided between the oven 31 and the heat press portion 32. Proximity sensors 35D and 35E are provided on the right end portion of the heat press portion 32. A proximity sensor 35F is provided on the right side of the first conveying unit 81 of the second staying area 8, such as on the wall surface 8A, for example. A proximity sensor 35G is provided on the front side of the third conveying unit 83, such as on the wall surface 8B, for example. The set position sensor 19, the staying area sensor 20, the proximity sensors 35A to 35G, and the infrared sensors 36A and 36B each detect the platen 4, and output a detection signal to the CPU 11 (refer to FIG. 6A) to be described later. Thus, the CPU 11 can recognize where each of the respective platens 4 are, and can display the positions of each of the platens 4 on the display portion 17.

Configuration of Platen 4

Figure 3:
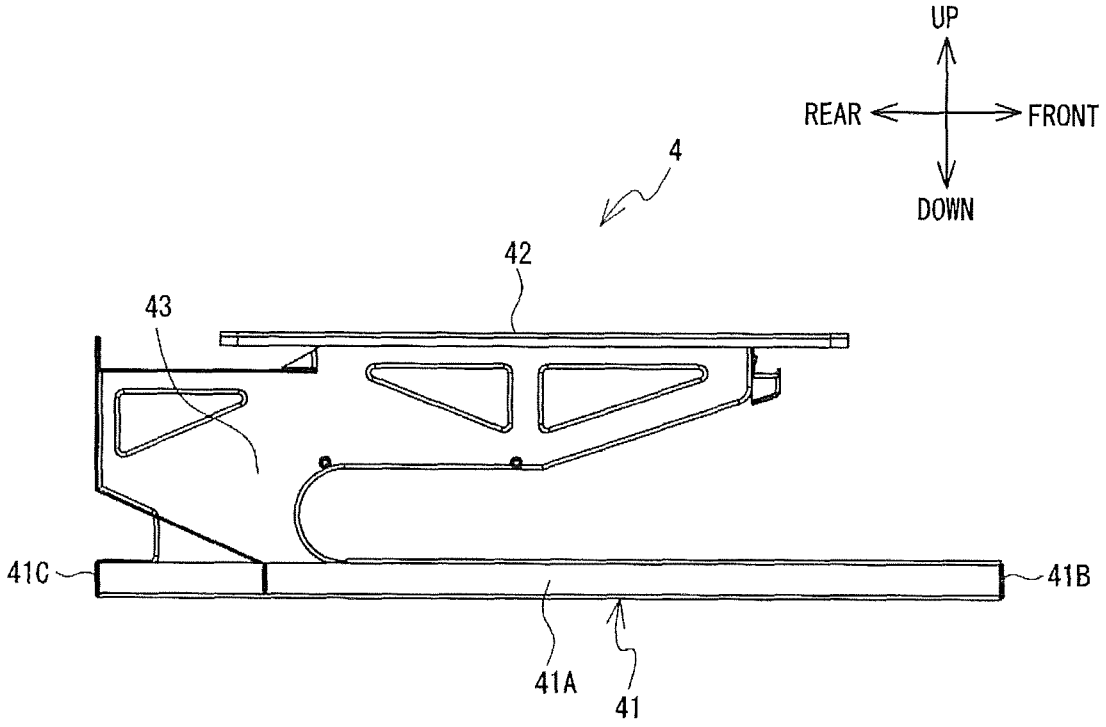
FIG. 3 is a left side view of a platen 4.
Figure 4:
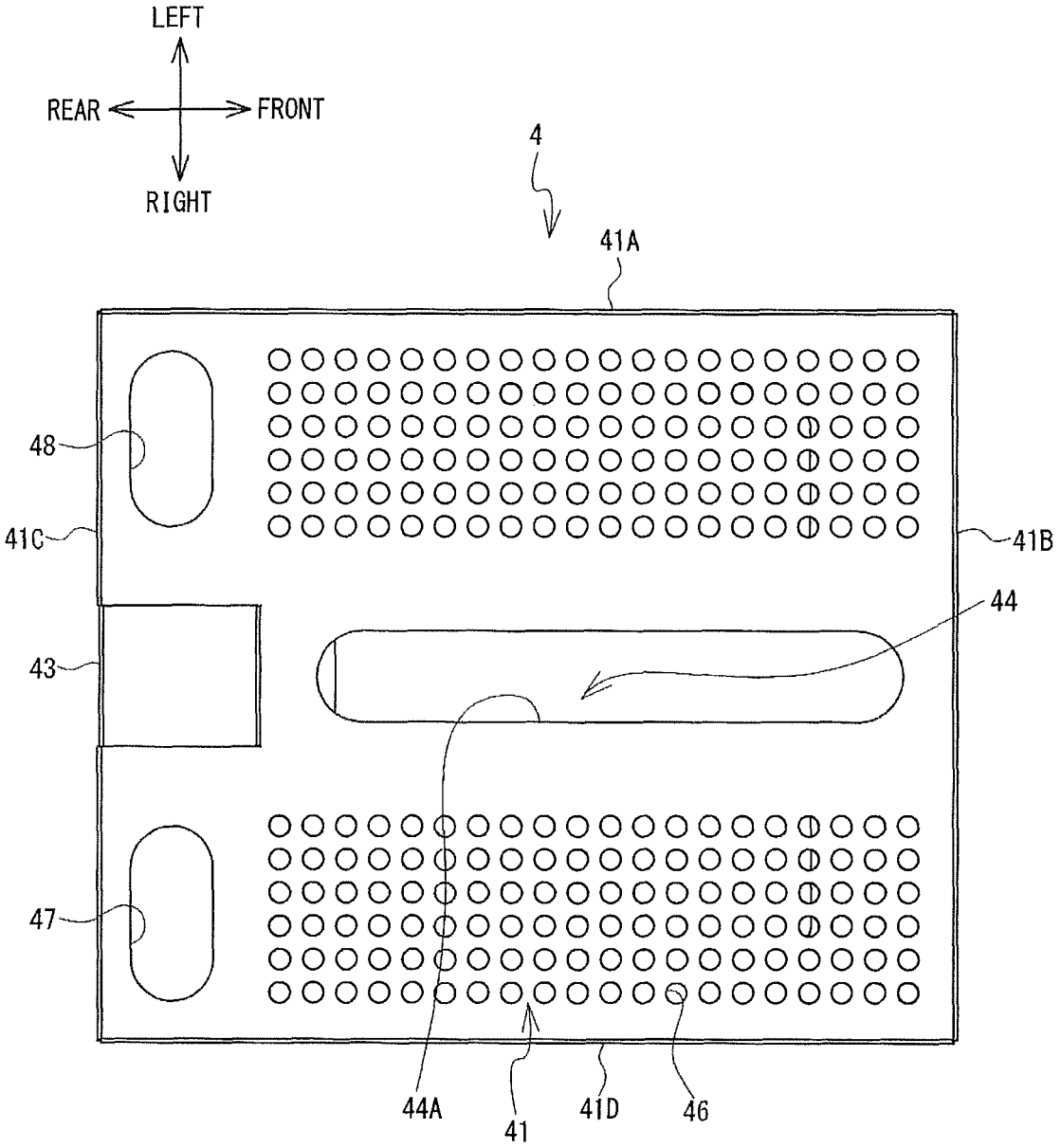
FIG. 4 is a bottom view of the platen 4.
Figure 5:
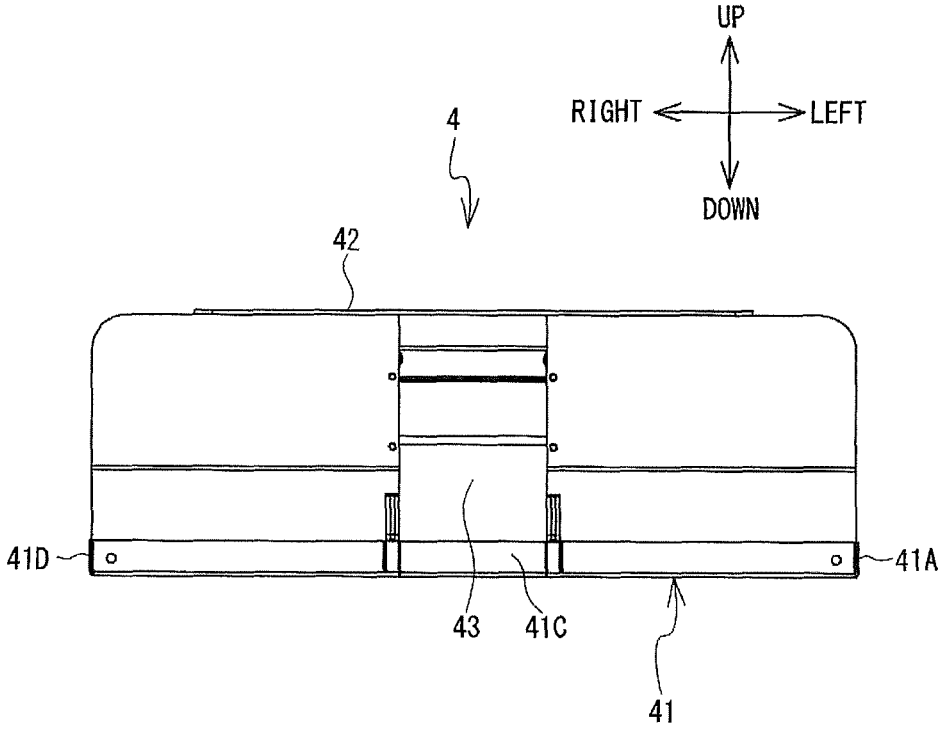
FIG. 5 is a rear view of the platen 4.

The configuration of the platen 4 will be explained with reference to FIG. 2 to FIG. 5. As shown in FIG. 3, the platen 4 is provided with at least the base portion 41, the top plate 42, and a support portion 43. As shown in FIG. 4, a bottom surface of the base portion 41 extends in the front-rear direction and the left-right direction, and is a plate that is substantially rectangular and long in the front-rear direction. The end surface 41A on the left side, and the end surface 41D on the right side of the base portion 41 extend in the front-rear direction. Further, the end surface 41B on the front side and the end surface 41C on the rear side of the base portion 41 extend in the left-right direction. The end surface 41A and the end surface 41D are orthogonal to the end surface 41B and the end surface 41C. Further, the position of the end surface 41A is determined by the end surface 41A coming into contact with the wall surface 9A. The position of the end surface 41C is determined by the end surface 41C coming into contact with the wall surface 9B. Further, the position of the end surface 41D is determined by the end surface 41D coming into contact with the wall surface 8A. In addition, the position of the end surface 41B is determined by the end surface 41B coming into contact with the wall surface 8B. A hole portion 44 that extends in the front-rear direction is formed in a central portion of the base portion 41. The hole portion 44 is an elliptical hole, for example. As shown in FIG. 13F, in a second embodiment to be described later, the stopper 74 can enter into the hole portion 44, and an end surface 44A on the right side of the hole portion 44 comes into contact with the stopper 74. A plurality of holes 46 are provided on the right side and the left side of the hole portion 44. The support portion 43 is fixed to the center, in the left-right direction, of a rear portion of the base portion 41. A pair of elliptical holes 47 and 48 are provided on the right side and the left side of the support portion 43 on the base portion 41. Due to each of the holes in the base portion 41, the weight of the platen 4 is reduced. As shown in FIG. 2, in a plan view, the top plate 42 is a plate that is substantially rectangular and long in the front-rear direction. Each of end surfaces on the left and right of the top plate 42 extend in the front-rear direction, and each of end surfaces on the front and rear of the top plate 42 extend in the left-right direction. As shown in FIG. 3 and FIG. 5, the top plate 42 and the base portion 41 are supported by the support portion 43 so as to be parallel to each other. The recording medium, such as the fabric or the like, is placed on the top plate 42. Note that a sponge or a towel may be placed on the base portion 41 so that the pretreatment agent does not leak below each of the belts.

Electrical Configuration of Pretreatment Apparatus 1

The electrical configuration of the pretreatment apparatus 1 will be explained with reference to FIG. 6A. The pretreatment apparatus 1 is provided with the CPU 11, a ROM 12, a RAM 13, a storage device 14, the application portion 2, the heat processing portion 3, the operation portion 16, the display portion 17, an input/output portion 18, the set position sensor 19, the staying area sensor 20, the code reader 21, the proximity sensors 35A to 35G, the infrared sensors 36A and 36B, drive circuits 22 to 25, 27, 28, 30, 33, and 34, and the like, which are all connected to each other via a bus. The CPU 11 controls the pretreatment apparatus 1, reads various programs from the ROM 12, uses the RAM 13 as a working memory and executes various processing. For example, the CPU 11 reads a set processing program from the ROM 12, and executes set processing to be described later. Note that the application portion 2, and the oven 31 and the heat press portion 32 that configure the heat processing portion 3 may each be provided with a CPU (not shown in the drawings), and these CPUs may receive commands from the CPU 11, and control the application portion 2, the oven 31, and the heat press portion 32.

The storage device 14 is a non-volatile storage device such as a flash memory, an HDD, or the like. The storage device 14 stores various parameters and the like. A desired command is input to the CPU 11 by the operator from the operation portion 16. The display portion 17 is provided with the touch panel (not shown in the drawings), and may function as the operation portion 16. The input/output portion 18 is provided with an SD memory card slot, a network connector, a USB port, and the like. The pretreatment apparatus 1 may be connected to an external device via a network.

The drive circuit 22 is connected to the set position belt motor 61A, and drives the set position belt motor 61A under the control of the CPU 11. The belts 61 rotate as a result. The drive circuit 23 is connected to the first staying area belt motor 71A and drives the first staying area belt motor 71A under the control of the CPU 11. The belts 71 rotate as a result. The drive circuit 24 is connected to the first conveying unit motor 81A, the second conveying unit motor 82A, and the third conveying unit motor 83A, drive the first conveying unit 81, the second conveying unit 82, and the third conveying unit 83 under the control of the CPU 11. Each of the belts 811 to 831 of the first conveying unit 81, the second conveying unit 82, and the third conveying unit 83 rotate as a result. The drive circuit 25 is connected to the fourth conveying unit motor 91A, the fifth conveying unit motor 92A, and the sixth conveying unit motor 93A, and drive the fourth conveying unit 91, the fifth conveying unit 92, and the sixth conveying unit 93 under the control of the CPU 11. Each of the belts 911 to 931 of the fourth conveying unit 91, the fifth conveying unit 92, and the sixth conveying unit 93 rotate as a result.

The drive circuit 27 is connected to the air cylinder 73A, the drives the air cylinder 73A under the control of the CPU 11. The stopper 73 is moved up and down as a result. The drive circuit 28 is connected to the air cylinder 63A, and drives the air cylinder 63A under the control of the CPU 11. The stopper 63 is moved up and down as a result. The drive circuit 30 is connected to the lifts 81B and 83B of the second staying area 8 and moves the lifts 81B and 83B up and down under the control of the CPU 11. As a result, the pair of belts 811 and the plate portion 812 of the first conveying unit 81, and the pair of belts 831 and the plate portion 832 of the third conveying unit 83 move up and down. The drive circuit 33 is connected to the lifts 91B and 93B of the first conveying path 9 and move the lifts 91B and 93B up and down under the control of the CPU 11. As a result, the pair of belts 911 and the plate portion 912 of the fourth conveying unit 91, and the pair of belts 931 and the plate portion 932 of the sixth conveying unit 93 move up and down. The drive circuit 34 is connected to the second conveying path motors 10A, 10B, and 10C and drives the second conveying path motors 10A, 10B, and 10C under the control of the CPU 11. The belts 101 rotate as a result. Note that the application portion 2, and the oven 31 and the heat press portion 32 configuring the heat processing portion 3 are controlled by CPU 11. Further, the lifts 66, 81B, 83B, 91B, and 93B are air cylinders, for example.

Electrical Configuration of Heat Press Portion 32

The electrical configuration of the heat press portion 32 will be explained with reference to FIG. 6B. The heat press portion 32 is provided with an air supply source 32A, an air passage member 32B, a first valve 32C, a pressure transducer 32D, a second valve 32E, an air cylinder 32F, the heat press plate 32G, and a third valve 32H. The air supply source 32A, the first valve 32C, the pressure transducer 32D, the second valve 32E, the air cylinder 32F, and the third valve 32H are connected to one another by the air passage member 32B and are arranged in this order from the upstream in a direction of air flow from the air supply source 32A.

The air supply source 32A is connected to the air passage member 32B. The air supply source 32A supplies air at a predetermined pressure (e.g., 100 PSI). The air supply source 32A may be a connector that connects the air passage member 32B and a pipe or tube that supplies compressed air provided in a factory where the pretreatment apparatus 1 is installed. In another example, the air supply source 32A may be an air pump that supplies air at a desired pressure.

The air passage member 32B is a mechanical structure that defines an air passage in which air flow. The air passage member 32B may be a tube or a pipe made from any appropriate material such as metal (e.g., stainless steel) or plastic (e.g., engineering plastics or synthetic resin).

The first valve 32C is connected to downstream of the air supply source 32A via the air passage member 32B. The first valve 32C, the second valve 32E, and the third valve 32H are configured to be switchable between an open state and a closed state. In the open state, the first valve 32C, the second valve 32E, and the third valve 32H allow air to pass therethrough. In the closed state, the first valve 32C, the second valve 32E, and the third valve 32H shut air not to pass therethrough. The first valve 32C, the second valve 32E, and the third valve 32H may be solenoid valves. The first valve 32C, the second valve 32E, and the third valve 32H may remain in the closed state in an initial state (i.e., no electric current is supplied) and may turn into the open state in response to supply of an electric current. The open/closed state of the valves may be controlled by the CPU 11 via a drive circuit (not show in the drawings). That is, the drive circuit may supply and stop electric current according to a control signal from the CPU 11.

The second valve 32E is connected to downstream of the first valve 32C via the air passage member 32B.

The pressure transducer 32D is connected to the air passage member 32B between the first valve 32C and the second valve 32E. The pressure transducer 32D is configured to output a pressure signal corresponding to air pressure in the air passage member 32B between the first valve 32C and the second valve 32E. Any commercial pressure transducer may be used as the pressure transducer 32D. The CPU 11 receives the pressure signal from the pressure transducer 32D.

The air cylinder 32F is connected to downstream of the second valve 32E via the air passage member 32B. The air cylinder 32F is located in the second conveying path 10. The heat press plate 32G is located above the air cylinder 32F. When the platen 4 is inside the heat press portion 32, the platen 4 is located between the air cylinder 32F and the heat press plate 32G in the up-down direction. When compressed air is supplied to the air cylinder 32F, the air cylinder 32F moves the platen 4 upward, thereby the platen 4 is pressed toward the heat press plate 32G at a predetermined pressure according to the air pressure in the air cylinder 32F.

The third valve 32H is connected downstream of the air cylinder 32F via the air passage member 32B. An air chamber, which is defined by the air passage member 32B between the first valve 32C and the second valve 32E, is equal in volume to an air cylinder chamber which is defined by the air passage member 32B between the second valve 32E and the air cylinder 32F, the air cylinder 32F, and the air passage member 32B between the air cylinder 32F and the third valve 32H. By virtue of the second valve 32E, it is possible to control air pressure in the air chamber and the air cylinder chamber independently. Therefore, it is possible to prepare compressed air in the air chamber for the next heat pressing at a pressure different from that of the ongoing heat pressing.

Set Processing

Figure 7:
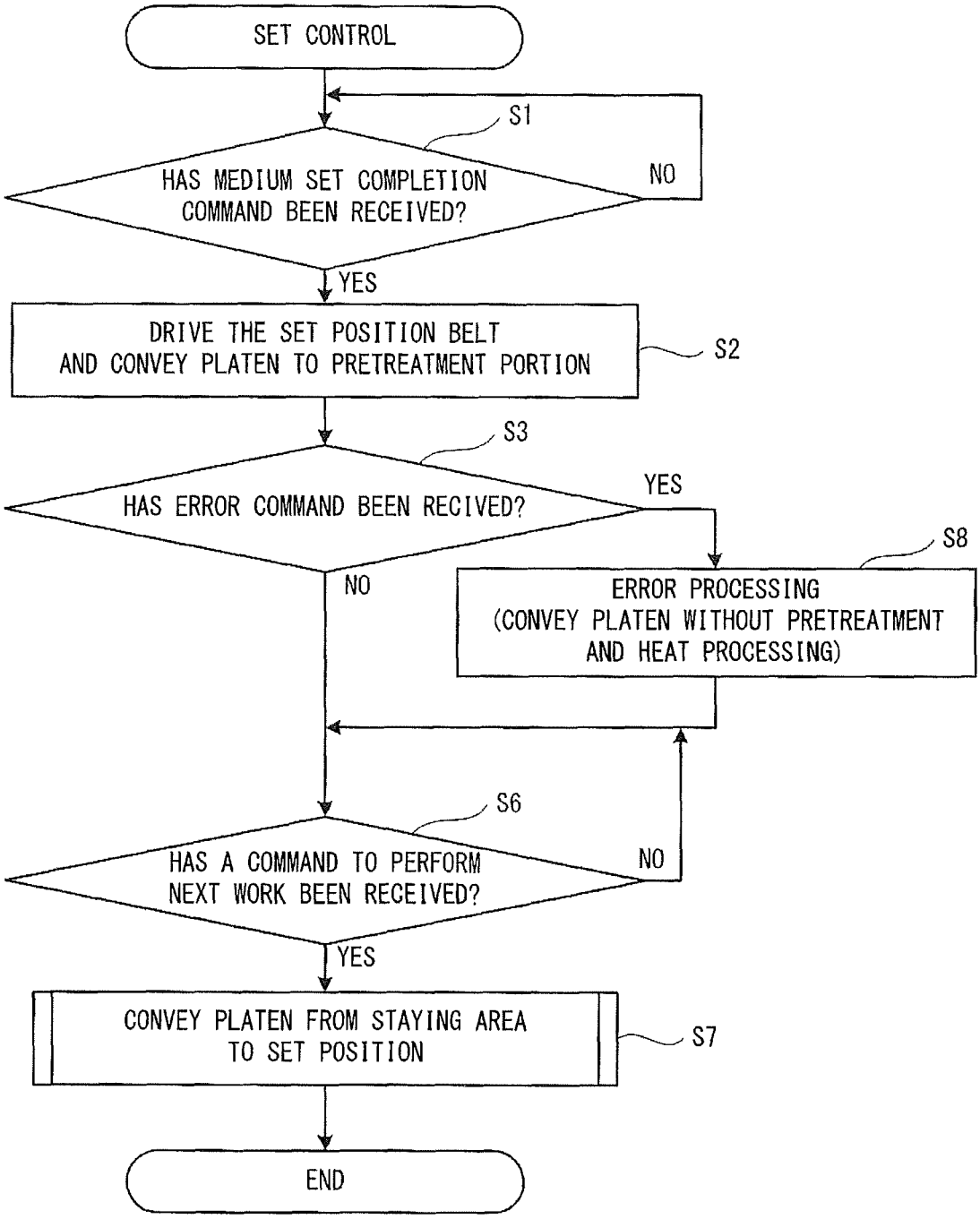
FIG. 7 is a flowchart of set processing.

A flow of the set processing will be explained with reference to FIG. 7. In a following example, the explanation uses the T-shirt as an example of the recording medium. The CPU 11 reads the set processing program from the ROM 12, uses the RAM 13 as the working memory, and performs the set processing. The set processing is started, for example, by being triggered by a power source of the pretreatment apparatus 1 being switched on. In the pretreatment apparatus 1, in accordance with the set processing, the platen 4 is moved from the first staying area 7 to the set position 6, the recording medium, such as the T-shirt or the like, is set on the platen 4, and the platen 4 is conveyed to the pretreatment portion 50. Thus, the pretreatment is performed on the recording medium placed on the platen 4.

First, the CPU 11 determines whether a command has been received indicating that the setting of the recording medium on the platen 4 is complete (step S1). For example, when the operator sets the recording medium on the platen 4, and inputs the command indicating that the setting of the recording medium on the platen 4 is complete, from the operation portion 16, the CPU 11 determines that the recording medium set completion command has been received (YES at step S1). The set completion command is input to the CPU 11, for example, when the start switches 16C are simultaneously pressed, when a recording medium set completion icon is touched by the operator on the display portion 17, or the like. Further, a recording medium set completion switch is separately provided on the operation portion 16, the set completion command may also be input to the CPU 11 when the recording medium set completion switch is pressed. When the CPU 11 determines YES in the determination at step S1, the CPU 11 performs processing at step S2. The processing at step S2 will be explained below. The CPU 11 drives the air cylinder 63A via the drive circuit 28, and lowers the stopper 63. Next, the CPU 11 drives the lift 91B via the drive circuit 33, raises the fourth conveying unit 91, and causes the belts 911 to be the same height as the belts 61. Next, the CPU 11 drives the set position belt motor 61A via the drive circuit 22, drives the fourth conveying unit motor 91A via the drive circuit 25, and feeds one of the platens 4, on which the recording medium has been set, to the fourth conveying unit 91. The platen 4 is conveyed in the leftward direction by the driving of each of the belts 911. Even when each of the end surfaces 41A and 41C of the base portion 41 of the platen 4 at the set position 6 are arranged in a state of being displaced form the left-right direction and the front-rear direction position, the end surface 41A of the base portion 41 of the platen 4 comes into contact with the wall surface 9A, and each of the end surfaces 41A and 41C are arranged in the left-right direction and the front-rear direction position, respectively. Further, the platen 4 is detected by the proximity sensor 35A. Next, the CPU 11 stops the set position belt motor 61A and the fourth conveying unit motor 91A.

Next, the CPU 11 lowers the lift 91B and lowers the fourth conveying unit 91. The platen 4 is placed on each of the belts 921 of the fifth conveying unit 92. Next, the CPU 11 drives the fifth conveying unit motor 92A via the drive circuit 25, drives each of the belts 921 in the rearward direction, and conveys the platen 4 in the direction of the sixth conveying unit 93. Even when each of the end surfaces 41A and 41C of the base portion 41 of the platen 4 on the belts 921 are arranged in a state of being displaced from the left-right direction and the front-rear direction, the end surface 41C of the base portion 41 of the platen 4 comes into contact with the wall surface 9B, and each of the end surfaces 41A and 41C are arranged in the left-right direction and the front-rear direction position, respectively. Further, the platen 4 is detected by the proximity sensor 35B. Since the area to be pretreated on the fabric placed on the platen 4, the pretreatment area of the pretreatment portion 50, and the area to be pretreated on the fabric are likely to coincide with each other, in the application of the pretreatment agent and the heat press operation to be described later, the pretreatment agent can be correctly applied to a desired position, and pressure can be applied to the recording medium set on the platen 4. Next, the CPU 11 drives the lift 93B via the drive circuit 33, raises the sixth conveying unit 93, and causes the belts 931 to be the same height as the belts 101. Next, the CPU 11 drives the sixth conveying unit motor 93A via the drive circuit 25, rotates the belts 931 in the rightward direction, rotates the belts 101 of the second conveying path 10 in the rightward direction using a motor not shown in the drawings, and conveys the platen 4 to the application portion 2.

Specifically, the pretreatment apparatus 1 according to the first aspect of the present disclosure includes the platen 4, the pretreatment portion 50 that pretreats the recording medium set on the platen 4, and the belts 61 911, 921, 931, 101, 811, 821, 831, and 71 that convey the platen 4 from the set position 6 at which the medium is placed on the platen 4 to the set position 6 via the pretreatment portion 50. Further, the pretreatment apparatus 1 according to the second aspect of the present disclosure is an example of the first aspect described above, the belts may include the first staying area 7 and the second staying area 8 where the platen 4 that has finished processing in the pretreatment portion 50 is caused to stay, and the belts may convey the platen 4 in the first staying area 7 to the set position 6, after the platen 4 on which the medium is set at the set position 6 is conveyed toward the pretreatment portion 50. Further, the pretreatment apparatus 1 according to the third aspect of the present disclosure is an example of the first aspect or the second aspect described above, the belt includes the belt 61 at the set position 6 and the belt 71 at the first staying area 7, the belt 71 may convey the platen 4 toward the set position 6 after the belt 61 conveys the platen 4.

Next, the CPU 11 determines whether an error command has been received (step S3). The CPU 11 performs the determination at step S3 over a period until the platen 4 reaches the application portion 2. Specifically, the CPU 11 performs the determination processing at step S3 until the proximity sensor 35C of the application portion 2 detects the platen 4.

For example, while the platen 4 is conveyed from the set position 6 and until the platen 4 reaches the second conveying path 10 via the first conveying path 9, there is a case in which "a not-normal state" of the T-shirt on the platen 4 is verified. In this case, with respect to a platen 4 that is being conveyed and is displayed on the display portion 17, the operator clicks the mouse 16B and inputs the error command from the operation portion 16 for the platen 4. An example of the "not-normal state" is a case in which the set state of the T-shirt on the platen 4 is not desirable. For example, the T-shirt may be reversed from front to rear, the T-shirt may be inside-out, there may be wrinkles in the T-shirt, the center position of the T-shirt on the platen 4 may be displaced from the center of the platen 4, a T-shirt that has already passed through the pretreatment may once more be passed through, and the like. Further, the "not-normal state" also applies when there is a mistake with respect to changes in a printing lot. Examples of a case in which the mistake occurs with respect to changes in the printing lot include when the size of the platen 4 and the size of the T-shirt do not match, when the color of the T-shirt is different to instructions, and the like.

When the CPU 11 determines that the error command has been received (YES at step S3), the CPU 11 performs error processing. The error processing is, for example, processing in which the CPU 11 associates an error with the platen 4 and stores the error in the storage device 14. For example, the CPU 11 stores an error flag in association with an processing number in the storage device 14. Further, as an example of the error processing, the CPU 11 causes the platen 4 to pass through the application portion 2 and the heat processing portion 3 without performing the pretreatment and the heat processing (step S8), and advances the processing to step S6. In the association of the error with the platen 4, the error flag may be stored in the storage device 14 in association with the barcode attached to the recording medium. Specifically, a processor of the pretreatment apparatus may determine whether the error command has been received, and may execute error processing when it is determined that the error command has been received.

When the CPU 11 does not determine that the error command has been received (NO at step S3), the platen 4 is already being conveyed to the pretreatment portion 50, and thus, the following processing is executed. The CPU 11 lowers the stopper 75 of the application portion 2 and drives the belts 101 in the rightward direction. The application portion 2 performs the pretreatment to apply the pretreatment agent to the T-shirt placed on the platen 4. An example of the pretreatment includes applying a predetermined amount of the pretreatment agent to the T-shirt on the platen 4. Next, when the proximity sensor 36A on the right side of the application portion 2 detects the platen 4, the CPU 11 rotates the net (not shown in the drawings) placed inside of the oven 31 in the rightward direction, and raises the stopper 75 of the application portion 2.

When the infrared sensor 36B on the right side of the oven 31 detects the platen 4, the CPU 11 rotates the belts (not shown in the drawings) placed inside the heat press portion 32 in the rightward direction. The oven 31 and the heat press portion 32 perform the heat processing on the T-shirt to which the pretreatment agent has been applied. Details of the heat pressing process will be described later. The oven 31 heats the T-shirt on the platen 4 at a predetermined temperature, for a predetermined time period. Further, the heat press portion 32 heat presses the T-shirt on the platen 4 at a predetermined pressure and temperature, for a predetermined time period. Note that, in the oven 31, a conveying belt (not shown in the drawings) can convey a plurality of the platens 4. If the plurality of platens 4 are being conveyed, the speed of the belts 101 upstream of the oven 31 may be reduced.

The heat press portion 32 prepares compressed air in the air passage member 32B between the first valve 32C and the second valve 32E prior to heat pressing. Specifically, the CPU 11 controls the first valve 32C, the second valve 32E and the third valve 32H to be in the closed state. Then, the CPU 11 controls the first valve 32C to be in the open state. Upon opening the first valve 32C, air flow from the air supply source 32A into the air passage member 32B between the first valve 32C and the second valve 32E, raising pressure therein. The CPU 11 monitors the pressure signal received from the pressure transducer 32D. In response to receiving the pressure signal that indicates a predetermined pressure (e.g., 35 PSI), the CPU 11 controls the first valve 32C to be in the closed state, thereby the compressed air is prepared. The operator may set a parameter that specifies the predetermined pressure via the operation portion 16. Alternatively, the predetermined pressure may be a prefix value determined in factory settings. These controls enable to prepare compressed air at a desired pressure even if the air supply source provides compressed air at a fixed pressure.

Timing of heat pressing is determined by referring the proximity sensors 35D and 35E located downstream of the air cylinder 32F and the heat press plate 32G in the second conveying path 10. When the platen 4 is located at a position where heat pressing is to be performed (i.e., a position between the air cylinder 32F and the heat press plate 32G in the up-down direction), the proximity sensors 35D and 35E detect the platen 4. In response to receiving detection signals from the proximity sensors 35D and 35E, the CPU 11 controls the second conveying path motor 10C, via the drive circuit 34, to stop conveying the platen 4. After the platen 4 has stopped, the CPU 11 controls the second valve 32E to be in the open state. Then the compressed air is transferred into the air cylinder chamber. Then, the CPU 11 controls the second valve 32E to be in the closed state. Now the pressure in the air cylinder 32F is set to a preferred value according to the parameter set by the operator. The air cylinder 32F is driven by the pressure and thereby moves the platen 4 upward such that the platen 4 is pressed toward the heat press plate 32G. Since the second valve 32E is opened in response to the detection signal from the proximity sensors 35D and 35E, it is possible to reduce a risk where the second valve 32E is opened when the platen 4 has not been located at the position where heat pressing is to be performed.

During the heat pressing, the CPU 11 controls the first valve 32C to be in the open state. Since the second valve 32E is in the closed state, air flow from the air supply source 32A into the air passage member 32B between the first valve 32C and the second valve 32E, raising pressure therein. The CPU 11 controls the first valve 32C to be in the closed state when the pressure signal indicates a pressure value for a next platen. This pressure value may be the same as that in the ongoing heat pressing or may be another value according to the setting by the operator. That is, during the ongoing heat pressing, the heat press portion 32 can prepare the compressed air for the next heat pressing. In another example, the heat press portion 32 may prepare the compressed air for the next heat pressing after the ongoing heat pressing has done (i.e., the first valve 32C may be opened after the third valve 32H has opened).

After a predetermined time has elapsed (i.e., the ongoing heat pressing has done), the CPU 11 control the third valve 32H to be in the open state such that the compressed air in the air cylinder 32F is released. The platen 4 moves downward as the release of the compressed air. The CPU 11 controls the third valve 32H to be in the closed state after the compressed air in the air cylinder 32F have been released. Then, the CPU 11 controls the second conveying path motor 10C, via the drive circuit 34, to start conveying the platen 4.

Next, the CPU 11 determines whether a command to move to a next work operation has been received (step S6). For example, when the operator inputs a command, from the operation portion 16, to move to the next work, the CPU 11 determines that the command to move to the next work has been received (YES at step S6). When the CPU 11 does not determine that the command to move to the next work has been received (NO at step S6), the CPU 11 repeats the processing at step S6. An example of the command to move to the next work includes, among others, the following three cases. There is a case in which the code reader 21 has read the barcode of the recording medium, a case in which the code reader 21 reads the barcode of the recording medium and a command indicating that the information displayed on the display portion 17 has been verified is input, a case in which the start switches 16 have been simultaneously pressed, and the like. Note that, examples of the information displayed on the display portion 17 include the color of the T-shirt, the size of the top plate of the platen, and the like. When the CPU 11 determines that the command to move to the next work has been received (YES at step S6), the CPU 11 conveys the platen 4 from the first staying area 7 to the set position 6 (step S7). Note that the determination at step S6 may be omitted.

First Conveying Control

Figure 8:
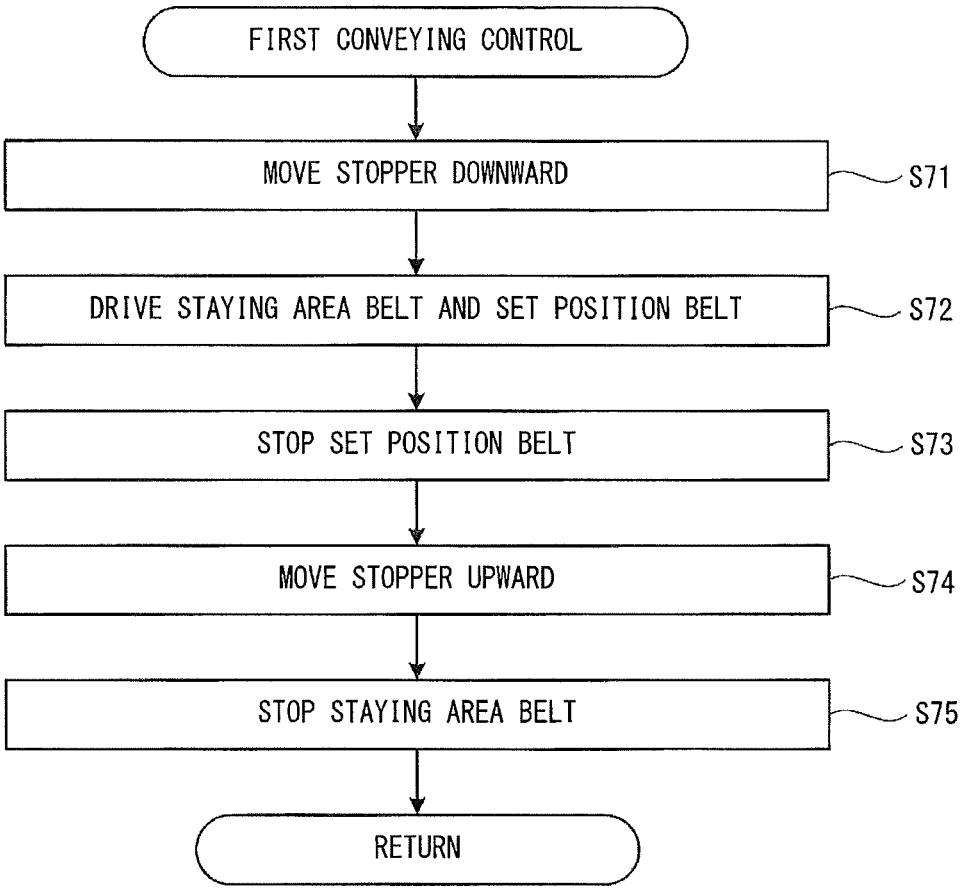
FIG. 8 is a sub-routine of first conveying processing.
Figures 12A, 12B, 12C:
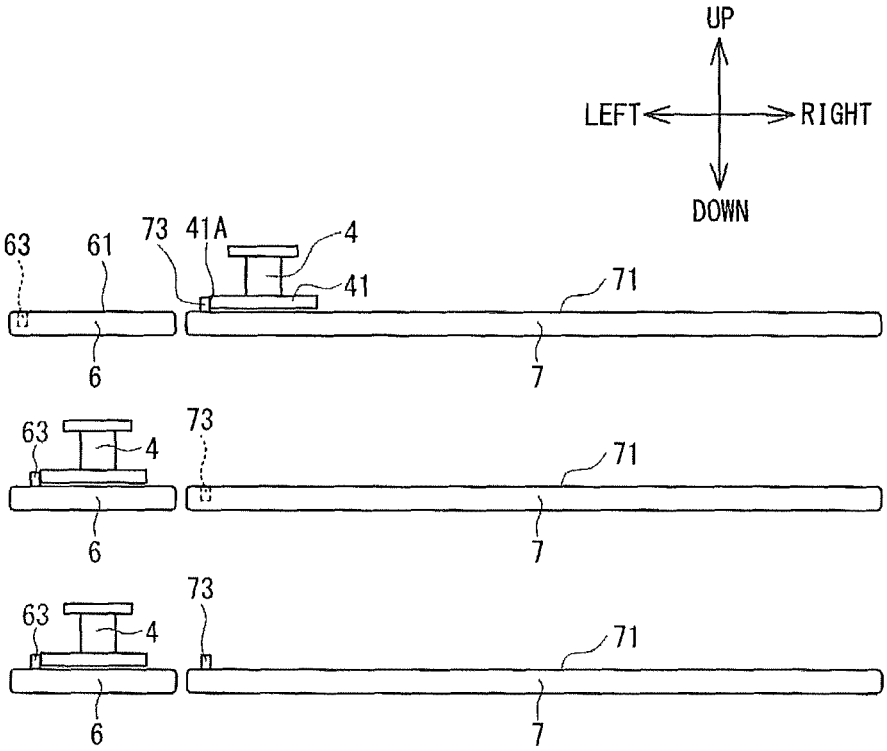
FIG. 12A to FIG. 12C are views showing states of conveying the platen 4 from a first staying area 7 to a set position 6.

A first working example of processing at step S7 will be explained with reference to a sub-routine of first conveying control shown in FIG. 8, and with reference to FIG. 6A, and FIG. 12A to FIG. 12C. As shown in FIG. 12A, in a state in which the stopper 73 of the first staying area 7 protrudes upward, the end surface 41A of the base portion 41 of the platen 4 comes into contact with the stopper 73. Thus, the stopper 73 restricts the platen 4 of the first staying area 7 from being conveyed to the set position 6. Next, when the set position sensor 19 has not detected the platen 4, the CPU 11 controls the air cylinder 73A (refer to FIG. 6A) via the drive circuit 27, and lowers the stopper 73 (step S71). Note that, when the set position sensor 19 has not detected the platen 4, this means the platen 4 is not at the set position 6, and thus, the stopper 73 may be lowered in advance. Next, via the drive circuit 23, the CPU 11 drives the first staying area belt motor 71A for a time period needed to convey one of the platens 4 from the first staying area 7 to the set position 6, and rotates the belts 71 (step S72). Note that the control of the rotation of the belts 71 need not necessarily be the time period, and the CPU 11 may rotate the belts 71 until the set position sensor 19 detects the platen 4. Immediately after, the CPU 11 rotates the set position belt motor 61A via the drive circuit 22, and rotates the belts 61 (step S72). As shown in FIG. 12B, the platen 4 is conveyed from the first staying area 7 to the set position 6. Next, the CPU 11 stops the set position belt motor 61A via the drive circuit 22, and stops the belts 61 (step S73). Next, as shown in FIG. 12C, the CPU 11 drives the air cylinder 73A (refer to FIG. 6A) via the drive circuit 23, and causes the stopper 73 to protrude upward (step S74). Next, the CPU 11 stops the first staying area belt motor 71A via the drive circuit 23, and stops the belts 71 (step S75). Next, the CPU 11 returns the processing to the set processing shown in FIG. 7.

Specifically, the pretreatment apparatus 1 according to the fourth aspect of the present disclosure is an example of the second aspect described above, the pretreatment apparatus 1 may be provided with the stopper 73 that protrudes upward from the belts 71 between the set position 6 and the first staying area 7, and restricts the platen 4 in the first staying area 7 from being conveyed toward the set position 6. The belts 61 may convey the platen 4 toward the pretreatment portion 50, and the stopper 73 may release the restriction of the platen 4 in the first staying area 7 after the platen 4 in the set position 6 has been conveyed toward the pretreatment portion 50.

In the first conveying control, the belts 61, 911, 921, 931, 101, 811, 821, 831, and 71 convey the platen 4 on which the recording medium has been placed from the set position 6 to the set position 6, via the pretreatment portion 50, and thus, the pretreatment agent can be applied, and the heat processing can be applied with respect to the plurality of fabrics within a specific period Further, the platen 4 in the first staying area 7 is conveyed toward the first staying area 7 after the platen 4 disposed at the set position 6 has been conveyed toward the application portion 2 and the heat processing portion 32, and thus, it is possible to reduce the occurrence of inefficiencies in which the operator conveys the empty platen 4 to the set position 6 or the like. After the platen 4 has been conveyed by the belts 61 of the set position 6, specifically, when there is not the platen 4 at the set position 6, the belts 71 of the first staying area 7 convey the platen 4 toward the set position 6, and thus, the conveying of the platen 4 from the first staying area 7 to the set position 6 when setting the recording medium on the platen 4 can be more reliably prevented. The stopper 73 protrudes upward from the belts 71 between the set position 6 and the first staying area 7. Thus, when setting the recording medium on the platen 4, it is possible to prevent the platen 4 from being conveyed from the first staying area 7 to the set position 6. Further, when the CPU 11 determines that the command to move to the next work has been received (YES at step S6), the CPU 11 moves to the next work. Thus, when the command to move to the next work has not been received (NO at step S6), the CPU 11 can reduce carrying of the platen 4 to the set position 6 by the belts 71. Further, when the CPU 11 determines that the error command has been received (YES at step S3), the CPU 11 can perform the error processing (step S8). For example, the CPU 11 associates the error with the platen 4 and stores the error in the storage device 14. Thus, for example, the operator can know the platen 4 in which the error has occurred. Further, for example, the platen 4 for which the error has occurred can be caused to pass through the application portion 2 and the heat processing portion 32, without performing the application of the pretreatment agent and the heat processing on the platen 4.

Second Conveying Control

Figure 9:
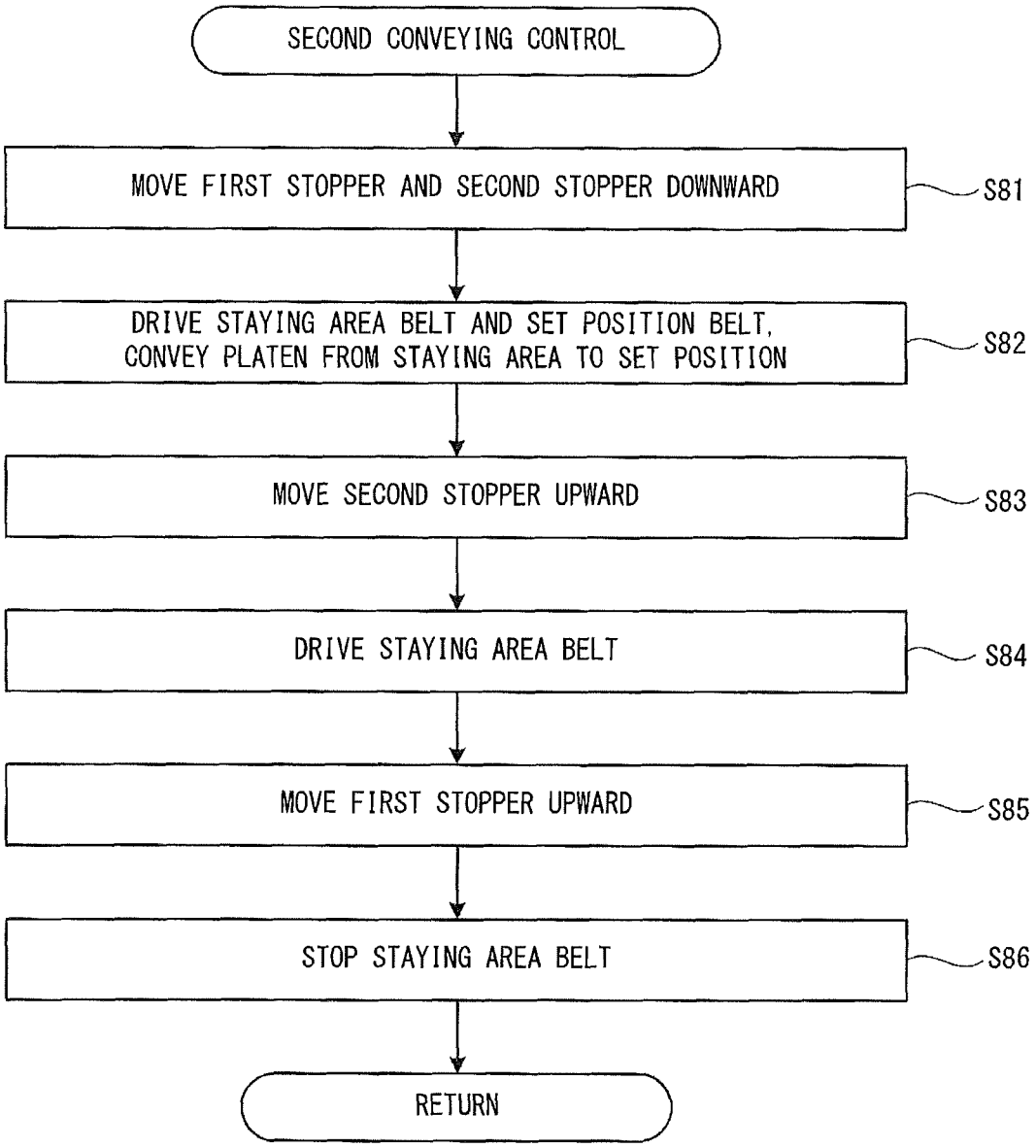
FIG. 9 is a sub-routine of second conveying processing.

Next, a second working example of the processing at step S7 will be explained with reference to a sub-routine of second conveying control shown in FIG. 9 and to FIG. 6A, and FIG. 13A to FIG. 13F. In the second working example shown in FIG. 13A to FIG. 13F, the stopper 74 is provided at a predetermined interval from the stopper 73, to the right of the stopper 73. The predetermined interval is, for example, 1.5 times or more of the length, in the left-right direction, of the base portion 41 of the platen 4. The stopper 74 is rod-shaped and extends in the front-rear direction, and is moved in the up-down direction by an air cylinder (not shown in the drawings).

FIG. 13A shows a case in which the platen 4 is initially introduced into the pretreatment apparatus 1, for example. In this case, an interval between the plurality of platens 4 sometimes becomes disordered. Here, first, the CPU 11 raises the stopper 74 using the air cylinder (not shown in the drawings) and moves the belts 71 to the left. The interval between the plurality of platens 4 becomes narrower (refer to FIG. 13A). Next, the CPU 11 lowers the stopper 74 and moves the belts 71 to the left. At this time, the CPU 11 keeps the stopper 73 raised (refer to FIG. 13B). At a timing at which the stopper 74 fits into the hole portion 44 of the base portion 41 of the second platen 4 from the left, the CPU 11 raises the stopper 74. The timing is predetermined based on a length of the base portion 41 in the left-right direction, the position of the hole 44, and the distance between the stopper 73 and the stopper 74. The belts 71 are moved to the left, and thus, the stopper 74 comes into contact with the end surface 44A of the hole portion 44. The stopper 74 restricts the platen 4 from being conveyed toward the left end portion of the first staying area 7. Thus, the leftmost first platen 4 is conveyed to the left, and the end surface 41A of the base portion 41 comes into contact with the stopper 73. In this way, it is possible to provide an appropriate interval between the platens 4 (refer to FIG. 13C).

When the second conveying control is started, as shown in FIG. 13D, the CPU 11 controls the air cylinder (not shown in the drawings) via the drive circuit (not shown in the drawings), lowers the stopper 74, controls the air cylinder 73A (refer to FIG. 6A) via the drive circuit 27, and lowers the stopper 73 (step S81). Next, via the drive circuit 23, the CPU 11 drives the first staying area belt motor 71A for a time period needed to convey one of the platens 4 from the first staying area 7 to the set position 6, and rotates the belts 71 (step S82). Immediately after that, the CPU 11 rotates the set position belt motor 61A via the drive circuit 22, and rotates the belts 61 (step S82). As shown in FIG. 13D, the platen 4 is conveyed from the first staying area 7 to the set position 6.

Next, as shown in FIG. 13E, the CPU 11 drives the air cylinder 73A (refer to FIG. 6A) via the drive circuit 27, and causes the stopper 73 to protrude upward (step S83). Next, via the drive circuit 23, the CPU 11 drives the first staying area belt motor 71A, and rotates the belts 71 (step S84). As a result, the end surface 41A of the base portion 41 of the platen 4 comes into contact with the stopper 73.

Next, as shown in FIG. 13F, the CPU 11 drives the air cylinder (not shown in the drawings) via the drive circuit 26, and causes the stopper 74 to protrude upward (step S85). The stopper 74 fits into the hole portion 44 of the platen 4, and, due to the leftward rotation of the belts 71, the stopper 74 comes into contact with the end surface 44A (refer to FIG. 6A) of the hole portion 44. Next, the CPU 11 stops the first staying area belt motor 71A via the drive circuit 23, and stops the belts 71 (step S86). The interval between the platen 4 in contact with the stopper 73, and the platen 4 in which the stopper 74 is fitted into the hole portion 44 is determined at the predetermined interval. The next operation to convey the platen 4 to the set position 6 is started from the state shown in FIG. 13C. Next, the CPU 11 returns the processing to the set processing shown in FIG. 7. Note that the processing at step S83 and step S85 may be performed in reverse, or may be performed simultaneously. Further, it is sufficient that the position of the stopper 74 be further to the right side of the platen 4 that has come into contact with the stopper 73, and in this case, the stopper 74 comes into contact with the left end surface 41A of the base portion 41 of the platen 4.

In the second conveying control, since the stopper 73 is provided in the first staying area 7, when setting the recording medium on the platen 4, the platen 4 can be physically prevented from being conveyed from the first staying area 7 to the set position 6. Further, since the stopper 74 is provided at the predetermined interval from the stopper 73 to the right of the stopper 73, when two of the platens 4 have stayed on the belts 71 in the first staying area 7, an interval at which the stopper 73 can enter between the two platens 4 can be created. Further, in the first working example and the second working example of processing at step S7 since the stopper 63 is provided at the set position 6, the platen 4 can be physically prevented from moving to the first conveying path 9. Thus, the platen 4 is stable when setting the recording medium on the platen 4.

Specifically, the pretreatment apparatus 1 according to the fifth aspect of the present disclosure is an example of the fourth aspect described above, the stoppers include the stopper 74 and the stopper 73, and the stopper 74 and the stopper 73 may be arranged with an interval therebetween longer than the length of the platen 4 in a conveying direction of the platen 4. The stopper 73 may restrict the platen 4 in the first staying area 7 from being conveyed toward the set position 6, and the stopper 74 may restrict the conveying of the platen 4 in the first staying area 7. Further, the pretreatment apparatus 1 according to the sixth aspect of the present disclosure is an example of the fifth aspect described above, the CPU 11 may raise the stopper 74 after raising the stopper 73. Further, the pretreatment apparatus 1 according to the seventh aspect of the present disclosure is an example of any one of the first aspect to the sixth aspect described above, the pretreatment apparatus 1 may be provided with the CPU 11 that receives an instruction to start conveying the platen 4 at the set position 6 toward the pretreatment portion 50, and the belts 61 may convey the platen 4 at the set position 6 when the CPU 11 receives the command. Further, the pretreatment apparatus 1 according to the ninth aspect of the present disclosure is an example of the eighth aspect described above, the CPU 11 determines whether an error command is received (step S3), and may perform the error processing (step S8) when it is determined that an error command has been received (step S3: YES).

Third Conveying Control

Figure 10:
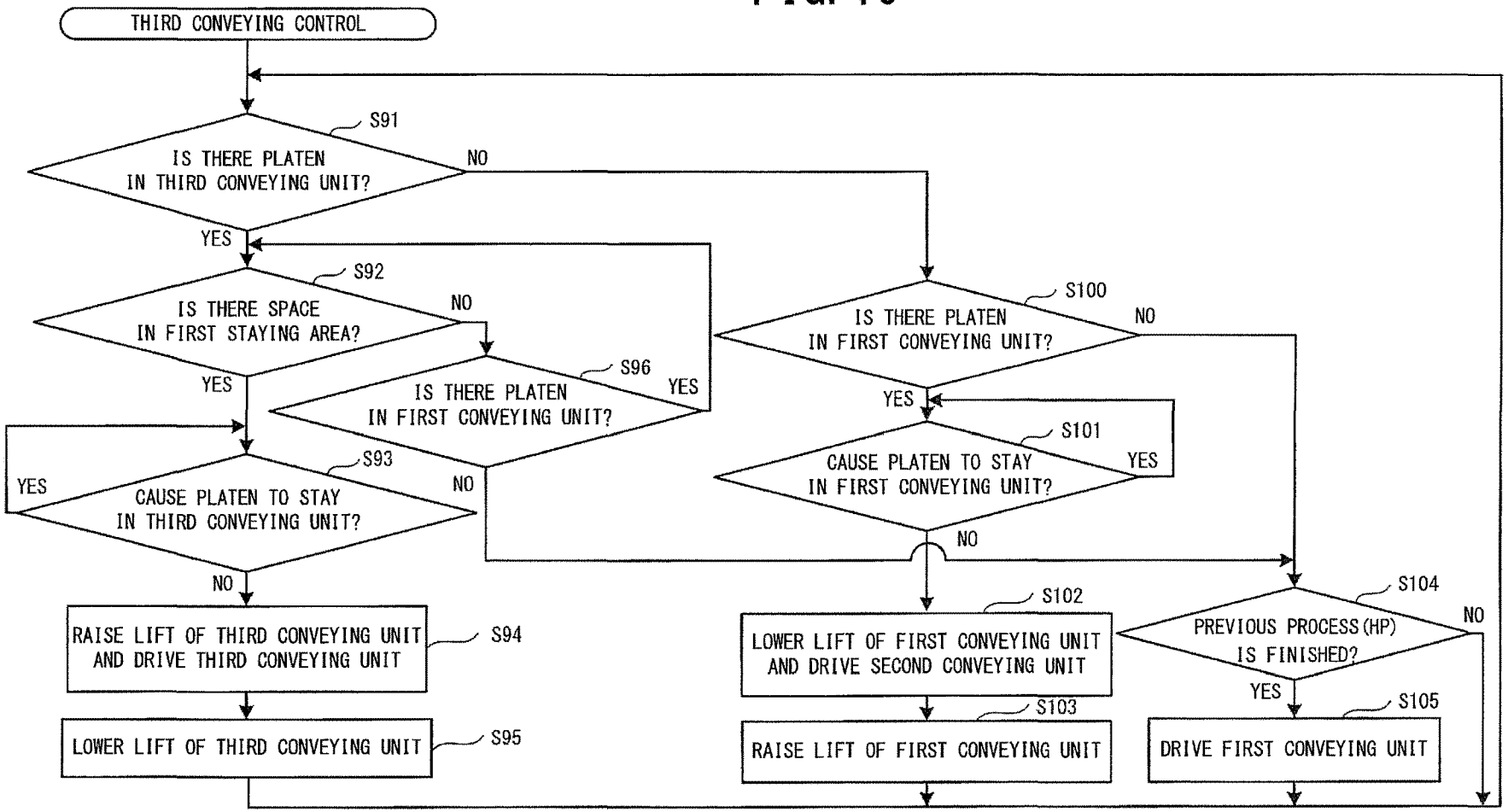
FIG. 10 is a flowchart of third conveying processing.
Figure 11:
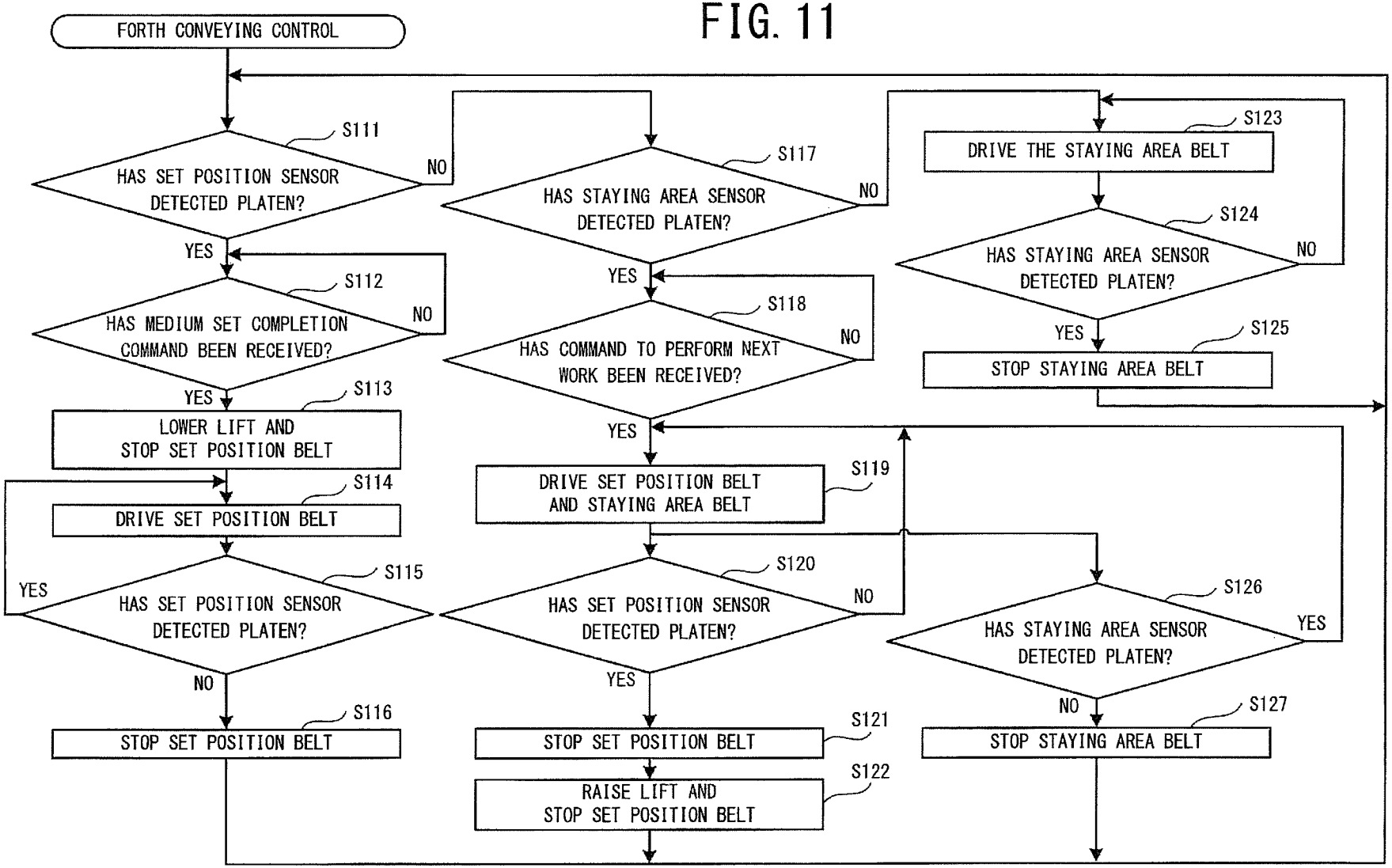
FIG. 11 is a flowchart of fourth conveying processing.

Next, third conveying control will be explained with reference to FIG. 2, FIG. 6A, and FIG. 10. The third conveying control is control to convey the platen 4 discharged from the heat processing portion 3 to the first staying area 7 via the second staying area 8. The CPU 11 performs the third conveying control separately from the set processing shown in FIG. 7. First, the CPU 11 reads a third conveying control program shown in FIG. 10 from the ROM 12, uses the RAM 13 as the working memory, and performs the third conveying control. The third conveying control is started, for example, by being triggered by the power source of the pretreatment apparatus 1 being switched on.

First, the CPU 11 determines whether there is the platen 4 in the third conveying unit 83 shown in FIG. 2 (step S91). For example, when the proximity sensor 35G provided on the third conveying unit 83 has detected the platen 4, the CPU 11 determines that there is the platen 4 in the third conveying unit 83 (YES at step S91). When the CPU 11 determines YES in the determination at step S91, the CPU 11 determines whether there is space to accommodate at least one of the platens 4 in the first staying area 7 (step S92).

For example, when the staying area sensor 20 provided in the first staying area 7 does not detect the platens 4, the CPU 11 determines that there is the space to accommodate the platen 4 in the first staying area 7 (YES at step S92).

Next, the CPU 11 determines whether the platen 4 is to be caused to stay in the third conveying unit 83 (step S93). For example, until a predetermined time period has elapsed from when the CPU 11 determines YES in the determination at step S91, the CPU 11 determines that the platen 4 is to be caused to stay in the third conveying unit 83 (YES at step S93). The predetermined time period is a heat dissipation time period over which the temperature of the platen 4 can be lowered to a predetermined temperature or below, and is stored in advance in the ROM 12. Further, when a predetermined temperature or above is detected by a thermometer provided in the proximity of the third conveying unit 83, the CPU 11 may determine that the platen 4 is to be caused to stay in the third conveying unit 83 (YES at step S93). The thermometer is, for example, a non-contact thermometer, such as a radiation thermometer or the like. The predetermined temperature is stored in advance in the ROM 12. When the CPU 11 has determined YES at step S93, the determination processing at step S93 is repeated. When the CPU 11 has determined NO at step S93, the CPU 11 drives the lift 83B of the third conveying unit 83 via the drive circuit 30, as shown in FIG. 6A, raises the third conveying unit 83, and causes the belts 831 to be the same height as the belts 71. Next, the CPU 11 drives the third conveying unit motor 83A via the drive circuit 24, also drives the first staying area belt motor 71A, and rotates the belts 831 and the belts 71 to the left to convey one of the platens 4 from the third conveying unit 83 to the first staying area 7 (step S94). Thus, the platen 4 is conveyed from the third conveying unit 83 to the first staying area 7. Next, the CPU 11 lowers the lift 83B (refer to FIG. 6A) of the third conveying unit 83 (step S95), and causes the third conveying unit 83 to be at the same height as the second conveying unit 82. Next, the CPU 11 advances the processing to step S91.

When the CPU 11 does not determine YES at step S91 (NO at step S91), the CPU 11 determines whether there is the platen 4 in the first conveying unit 81 shown in FIG. 2 (step S100). For example, when the platen 4 is detected by the proximity sensor 35F provided in the first conveying unit 81, the CPU 11 determines that there is the platen 4 in the first conveying unit 81 (YES at step S100). Next, the CPU 11 determines whether the platen 4 is to be caused to stay in the first conveying unit 81 (step S101). Until a predetermined time period has elapsed from when the CPU 11 determines YES in the determination at step S100, the CPU 11 determines that the platen 4 is to be caused to stay in the first conveying unit 81 (YES at step S101). The predetermined time period is a heat dissipation time period over which the temperature of the platen 4 can be lowered to a predetermined temperature or below, and is stored in advance in the ROM 12. Further, when a predetermined temperature or above is detected by a thermometer provided in the proximity of the first conveying unit 81, the CPU 11 determines that the platen 4 is to be caused to stay in the first conveying unit 81 (YES at step S101). The determination at step S101 is the same as the determination at step S93. When the CPU 11 has determined YES at step S101, the determination processing at step S101 is repeated. When the CPU 11 has determined NO at step S101, the CPU 11 lowers the lift 81B (refer to FIG. 6A) of the first conveying unit 81 (step S102), and causes the belts 811 of the first conveying unit 81 to be the same height as the belts 821 of the second conveying unit 82. Next, the CPU 11 drives the second conveying unit motor 82A, rotates the belts 821 to the front, conveys the platen 4 from the first conveying unit 81 to the third conveying unit 83, and raises the lift 8 1 B (refer to FIG. 6A) of the first conveying unit 81 (step S103). Next, the CPU 11 advances the processing to step S91.

When the CPU 11 does not determine YES at step S92 (NO at step S92), the CPU 11 determines whether there is the platen 4 in the first conveying unit 81 (step S96). When the CPU 11 has determined that there is the platen 4 in the first conveying unit 81 (YES at step S96), the CPU 11 advances the processing to step S92. When the CPU 11 does not determine YES at step S96 (NO at step S96), the CPU 11 determines whether the processing of a previous process is finished (step S104). An example of the previous process is the heat press. For example, when the heat press has been performed for a fixed time period by the heat press portion 32, the CPU 11 determines that the processing of the previous processing is finished (YES at step S104). When the CPU 11 has determined YES at step S104, in a state in which the rotation of the first conveying unit 81 is stopped, the CPU 11 raises the lift 81B of the first conveying unit 81. Therefore, the belts 811 is the same height as the belts (not shown in the drawings) below the heat press portion 32 of the second conveying path 10. Next, the CPU 11 drives the first conveying unit motor 81A via the drive circuit 24 (step S105). As a result, the belts 811 rotates in the rightward direction, and receives the platen 4 discharged from the heat press portion 32. Next, the CPU 11 stops the driving of the first conveying unit motor 81A. Next, the CPU 11 advances the processing to step S91. Also when the CPU 11 does not determine YES at step S104 (NO at step S104), the CPU 11 advances the processing to step S91.

Specifically, the pretreatment apparatus 1 according to the eighth aspect of the present disclosure is an example of any one of the second, the fourth, the fifth and the sixth aspects described above, the processor 11 may determine whether there is an empty space for the platen 4 to stay in the first staying area 7 (step S92), and may convey the platen 4 from the second staying area 8 to the first staying area 7 when it is determined that there is the empty space in the first staying area 7 (YES at step S92). Further, the pretreatment apparatus 1 according to the tenth aspect of the present disclosure is an example of the eighth aspect described above, the processor 11 may determine whether the platen 4 is to be caused to stay in the second staying area 8 (step S93, step S101), and may cause the platen 4 to stay in the second staying area 8 for a certain period of time so as to cool the platen 4, when it is determined that the platen 4 is to be caused to stay in the second staying area 8 (YES at step S93; YES at step S101).

As described above, by the third conveying control, the platen 4 discharged from the heat processing portion 3 that is the previous process is conveyed by the first conveying unit 81, the second conveying unit 82, and the third conveying unit 83 in the second staying area 8, and is conveyed to the first staying area 7. Thus, the platen 4 is turned by 180 degrees. The second staying area 8 can cause the platen 4 received from the previous process to stay depending on a state of emptiness of the first staying area 7. Further, the second staying area 8 can cause the maximum of two of the platens 4 to stay therein. Thus, when there is not the empty space in the first staying area 7, it is possible to cause the platen 4 to stay in the second staying area 8, and not convey the platen 4 to the first staying area 7. Furthermore, when the temperature of the platen 4 is higher than the predetermined temperature, the platen 4 can be used to stay in the second staying area 8 and the platen 4 can be cooled.

Fourth Conveying Control

Next, fourth conveying control will be explained with reference to FIG. 2, FIG. 6A, and FIG. 11 to FIG. 14. The fourth conveying control is a modified example of the processing to convey the platen 4 from the first staying area 7 to the set position 6. The CPU 11 reads a fourth conveying control program shown in FIG. 11 from the ROM 12, uses the RAM 13 as the working memory, and performs the fourth conveying control. The fourth conveying control is started, for example, by being triggered by the power source of the pretreatment apparatus 1 being switched on.

Figure 14:
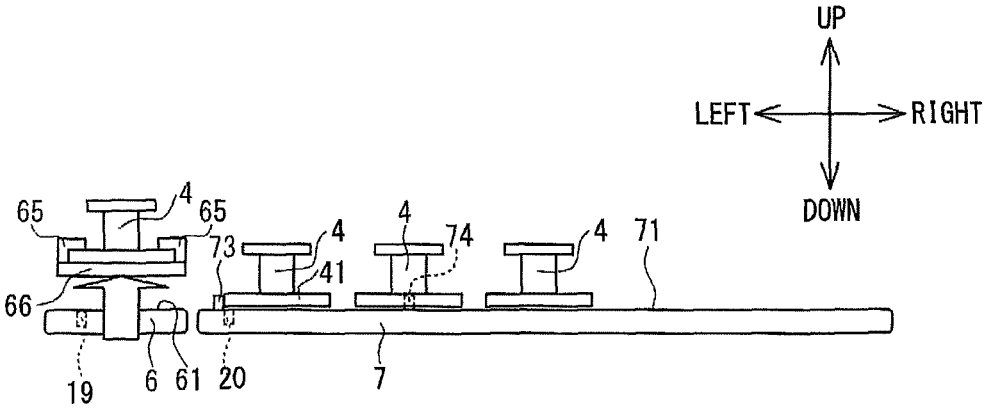
FIG. 14 is a view showing a state in which the platen 4 is fixed, at the set position 6.

As shown in FIG. 14, a lift 66 is provided in the set position 6. The lift 66 is a raising/lowering device that moves the platen 4 stopped at the set position 6 up and down, and is, for example, provided with an air cylinder (not shown in the drawings). Further, the lift 66 is connected to a drive circuit (not shown in the drawings) and moves up and down under the control of the CPU 11. Further, in the set position 6, a pair of the fixing portions 65 are provided that fix the platen 4 that has been raised by the lift 66. A fixing portion 65 is provided in a position that does not obstruct an operation when an operator sets a T-shirt on the platen 4, and the fixing portion 65 fixes a base portion 41, for example. Specifically, the fixing portion 65 may be a platen fixing portion that fixes the platen at the set position 6. As shown in FIG. 14, when the recording medium is set on the platen 4 at the set position 6, the platen 4 is in a state of being raised by the lift 66. Note that a proximity sensor (not shown in the drawings) is also provided on the lift 66, and the proximity sensor detects the state in which the platen 4 has been lifted up by the lift 66. The set position sensor 19 detects, in the left-right direction, the presence or absence of the platen 4 in the set position 6 regardless of whether or not the lifted-up state. First, the CPU 11 determines whether the set position sensor 19 has detected the platen 4 (step S111). When the CPU 11 receives, from the set position sensor 19, a signal that the platen 4 has been detected, for example, the CPU 11 determines that the platen 4 has been detected (YES at step S111).

Next, the CPU 11 determines whether a command has been received indicating that the setting of the recording medium on the platen 4 is complete (step S112). The determination at step S112 is the same as the determination at step S1 in FIG. 7. When the CPU 11 does not determine YES in the determination processing at step S112, the CPU 11 repeats the determination at step S112. When the CPU 11 has determined YES in the determination processing at step S112, the platen 4 is in a lifted up state, the CPU 11 lowers the lift 66 of the set position 6 in the state shown in FIG. 14, via the drive circuit 29, and stops the set position belt motor 61A via the drive circuit 22 (step S113). Thus, the belts 61 of the set position 6 shown in FIG. 2 are stopped. Next, the CPU 11 drives the set position belt motor 61A via the drive circuit 22, and rotates the belts 61 in the leftward direction (step S114). At this time, the CPU 11 drives the lift 91B via the drive circuit 33, moves the fourth conveying unit 91 up, and causes the height of the belts 911 to be the same as that of the belts 61. Next, the CPU 11 determines whether the set position sensor 19 has detected the platen 4 (step S115). When the CPU 11 determines YES in the determination processing at step S115, the CPU 11 returns the processing to step S114. This is in order to feed the platen 4 at the set position 6 to the first conveying path 9. When the CPU 11 no longer determines that the platen 4 has been detected by the set position sensor 19 (NO at step S115), the CPU 11 stops the set position belt motor 61A, and stops the driving of the belts 61 (step S116). This is because the platen 4 at the set position 6 has been fed to the first conveying path 9. The CPU 11 drives the lift 91B via the drive circuit 33, moves the fourth conveying unit 91 down, and causes the belts 911 to a position lower than the belts 921.

When, in the determination processing at step S111, the platen 4 has not been detected by the set position sensor 19 (NO at step S111), the CPU 11 determines whether the platen 4 has been detected by the staying area sensor 20 (step S117). When the staying area sensor 20 has detected the platen 4 (YES at step S117), the CPU 11 determines whether a command to move to the next work has been received (step S118). The determination at step S118 is the same as that at step S6 in FIG. 7. When the CPU 11 has determined that the command to move to the next work has been received (YES at step S118), the CPU 11 drives the first staying area belt motor 71A, rotates the belts 71, also rotates the set position belt motor 61A, and rotates the belts 61 (step S119). This is in order to feed the platen 4 from the first staying area 7 to the set position 6. Further, when the CPU 11 does not determines YES in the determination processing at step S118 (NO at step S118), the CPU 11 continues the determination at step S118. In addition, the processing at step S118 may not be executed.

Next, the CPU 11 determines whether the set position sensor 19 has detected the platen 4 (step S120) at the same time as determining whether the staying area sensor 20 has detected the platen 4 (step S126). When the CPU 11 does not determine YES in the determination processing at step S120 (NO at step S120), the CPU 11 returns the processing to step S119. Further, when the CPU 11 has determined YES in the determination processing at step S126, the CPU 11 returns the processing to step S119. This is in order to feed the platen 4 from the first staying area 7 to the set position 6. When the CPU 11 has determined YES in the determination processing at step S120 (yes at step S120), the CPU 11 stops the set position belt motor 61A and stops the belts 61 (step S121). This is because the platen 4 has been conveyed to the set position 6.

Next, the CPU 11 raises the lift 66, raises the platen 4 as shown in FIG. 14, and stops the belts 61 (step S122). Thus, the platen 4 is fixed by the fixing portions 65. As a result, the T-shirt or the like is easily mounted on the platen 4. Further, when the CPU 11 determines NO in the determination processing at step S126, the CPU 11 stops the first staying area belt motor 71A and stops the belts 71 (step S127). This is because the platen 4 has been fed from the first staying area 7 to the set position 6. Further, when the CPU 11 does not determines YES in the determination processing at step S118 (NO at step S118), the CPU 11 continues the determination at step S118. Note that the process of S118 may not be executed.

When, in the determination processing at step S117, the CPU 11 does not determine that the staying area sensor 20 has detected the platen 4 (NO at step S117), the CPU 11 drives the first staying area belt motor 71A, and rotates the belts 71 (step S123). This is in order to convey the platen 4 to the left end side of the first staying area 7. Next, the CPU 11 determines whether the staying area sensor 20 has detected the platen 4 (step S124). When the staying area sensor 20 has detected the platen 4 (YES at step S124), the CPU 11 stops the first staying area belt motor 71A, and stops the belts 71 (step S125). This is because, as shown in FIG. 14, the platen 4 has been conveyed to the left end side of the first staying area 7. When, in the determination processing at step S124, the CPU 11 does not determine that the staying area sensor 20 has detected the platen 4 (NO at step S124), the CPU 11 returns the processing to step S113. After step S116, step S122, step S125, and step S127, the CPU 11 advances the processing to step S111.

Specifically, the pretreatment apparatus 1 according to the eleventh aspect of the present disclosure is an example of any one of the second, the fourth, the fifth, the sixth, the eighth, the ninth and the tenth aspects described above, the pretreatment apparatus 1 may be further provided with the set position sensor 19 that detects the platen 4 at the set position 6, and the staying area sensor 20 that detects the platen 4 in the first staying area 7. The belts 71 may convey the platen 4 from the first staying area 7 to the set position 6 when a state changes from a state of detecting the platen 4 by the set position sensor 19 to a state of not detecting the platen 4 by the set position sensor 19. The state in which the set position sensor 19 detects the platen 4 is, for example, a state in which YES is determined in the process at step S111, and then the platen 4 is conveyed to the pretreatment portion 50 in the process at step S114. In this state, since the set position sensor 19 does not detect the platen 4, the process at step S111 is executed again after the process at step S116, and the CPU 11 determines NO in the process at step S111. This state is a state where the set position sensor 19 described above does not detect the platen 4. Further, the pretreatment apparatus 1 according to the twelfth aspect of the present disclosure is an example of any one of the first to the eleventh aspects described above, the pretreatment apparatus 1 may be provided with the fixing portion 65 at the set position 6. The fixing portion 65 may fix the platen 4 at the set position 6.

As described above, in the fourth conveying control, when the state changes from the state of detecting the platen 4 by the set position sensor 19 to the state of not detecting the platen 4 by the set position sensor 19, the belts 71 convey the platen 4 from the first staying area 7 to the set position 6. Further, when the state of not detecting the platen 4 by the set position sensor 19 changes to the state of detecting the platen 4 by the set position sensor 19, the lift 66 raises the platen 4, and the platen 4 is fixed to the fixing portions 65. Thus, the operator can set the medium on the platen 4 in the state of being fixed by the fixing portions 65, and a possibility can be reduced of the medium moving with respect to the platen 4. Thus, the recording medium can be easily fixed on the platen 4. As a result, it is possible to reduce an operation load on the operator from finishing setting the recording medium on the platen 4 to setting the recording medium on the next platen 4.

In the above-described embodiments, the CPU 11 rotates the belts 61 and 71 based on the detection results of the platen 4 by the sensors 19 and 20, and the platen 4 is conveyed. However, the following cases are considered, the rotation of the belts 61 and 71 is fast, malfunction of sensors 19, 20, the conveyance state of the platen 4 by the belts 61 and 71 is poor in spite of a presence of the platen 4, and the member of the platen 4 is not in the detection area of the sensors 19 and 20. Therefore, there is a possibility that the sensors 19 and 20 cannot detect the platen 4. In this case, since the platen 4 is conveyed to the next process at an unintended timing, stoppers 63, 73, and 74 that forcibly prevent the platen 4 from being fed are provided. Therefore, the stoppers 63, 73, and 74 physically restrict the movement of the platen 4 and prevent the platen 4 from being conveyed to the next process at an unintended timing.

The present disclosure is not limited to the above-described embodiments, and various modification are possible. For example, in the third conveying control shown in FIG. 10, the determination processing at step S93 and at step S1010 need not necessarily be performed. Further, the interval between the stopper 74 and the stopper 73 is not limited to being 1.5 times the length of the platen 4 in the conveying direction, and may be longer than 1.5 times the length.

The pretreatment portion 50 may not include the heat processing portion 3. Further, the heat processing portion 3 may be only one of the oven 31 and the heat press portion 32. Further, the belts 71 of the first staying area 7 may be divided into a plurality of sections in the left-right direction. Proximity sensors may be provided on each of the plurality of divided sections. Further, a belt driving portion and a CPU may be provided on each of the divided sections of the first staying area 7, and each of the CPUs may respectively control the driving portion of each of the sections.

For example, CPUs may be provided corresponding to each of the set position 6, the first conveying path 9, the second conveying path 10, the second staying area 8, and the first staying area 7, and each of the CPUs may be configured to control the belts, the lifts, the stoppers, and the like. Therefore, the third conveying control may be performed by a separate CPU from the CPU 11 that controls the second staying area 8. Further, the application portion 2, the oven 31, the heat press portion 32 may each be provided with a CPU, and each of the CPUs may control the application processing, the heat processing, and the heat press operation. The base portion 41 of the platen 4 is not limited to the rectangular shape that is long in the front-rear direction, and may be a rectangular shape that is long in the left-right direction, or may be a square shape. Further, the belts are not limited to two, and may be a belt conveyor configured by a single wide belt. Further, the conveying path 5 is not limited to the belts, and may be a rail, a conveyor or the like. The pretreatment apparatus 1 according to the thirteenth aspect of the present disclosure is an example of any one of the first to twelfth aspects described above, and the pretreatment portion 50 includes the application portion 2 and the heat processing portion 3. The application portion 2 may apply the pretreatment agent to the fabric set on the platen 4, and the heat processing portion 3 may perform heat processing on the fabric set on the platen 4.

In addition, the example of the air cylinders 63A and 73A, the lifts 66, 81B, 83B, 91B, and 93B is the air cylinder, but they may also be electromagnetic actuators. Further, at step S72 of the first conveying control shown in FIG. 8, the CPU 11 drives the first staying area belt motor 71A for the time period needed to convey one of the platens 4 from the first staying area 7 to the set position 6, and rotates the belts 71. The present disclosure is not limited to this example, and the CPU 11 may drive the first staying area belt motor 71A and rotate the belts 71 until the set position sensor 19 detects the platen 4. On the frame 100, the conveying path 5 is provided with the first staying area 7 and the set position 6 on the front side, the second staying area 8 on the right side, the first conveying path 9 on the left side, and the second conveying path 10 on the rear side, but the arrangement is not necessarily limited to this example. The arrangement may be reversed in the left-right direction and reversed in the front-rear direction. From the set position 6, the first conveying path 9, the second conveying path 10, the second staying area 8, and the first conveying path 9 are arranged in the clockwise direction, but the set position 6 may be provided on the right end side at the front of the pretreatment apparatus 1, and the first conveying path 9, the second conveying path 10, the second staying area 8, and the first conveying path 9 may be arranged in the counterclockwise direction. Further, in the pretreatment apparatus 1, the application portion 2, the oven 31, and the heat press portion 32 are arranged in the left-right direction, but may be arranged in the front-rear direction. The proximity sensors 35A to 35G may be optical sensors. Further, the first staying area 7 has a linear shape, but may include a bent portion. Further, the first staying area 7 may be curved.

The belts 61, 911, 921, 931, 101, 811, 821, 831, and 71 of the above-described embodiments are an example of a "belt" of the present disclosure. The stopper 74 is an example of a "first stopper" of the present disclosure. The stopper 73 is an example of a "second stopper" of the present disclosure. The stopper 63 is an example of a "third stopper" of the present disclosure.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A pretreatment apparatus comprising:

a platen;

a pretreatment portion configured to pretreat a medium to be printed set on the platen; and a belt configured to convey the platen from a set position to the set position via the pretreatment portion, the set position being a position at which the medium is placed on the platen.

2. The pretreatment apparatus according to claim 1, wherein the belt includes a staying area where the platen that has finished processing in the pretreatment portion is caused to stay, and the belt conveys the platen in the staying area to the set position, after the platen on which the medium is placed at the set position is conveyed toward the pretreatment portion.

3. The pretreatment apparatus according to claim 2, further comprising:

a stopper configured to restrict the platen in the staying area from being conveyed toward the set position, and the stopper configured to protrude upward from the belt between the set position and the staying area, wherein the belt is configured to convey the platen toward the pretreatment portion, and the stopper releases restriction of the platen in the staying area after the platen in the set position is conveyed toward the pretreatment portion.

4. The pretreatment apparatus according to claim 3, wherein the stopper includes a first stopper and a second stopper, the first stopper and the second stopper are arranged with an interval therebetween longer than a length of the platen in a conveying direction of the platen, the second stopper configured to restrict the platen in the staying area from being conveyed toward the set position, and the first stopper configured to restrict the conveying of the platen in the staying area.

5. The pretreatment apparatus according to claim 4, further comprising:

a processor; and a memory storing computer-readable instructions that, when executed by the processor, cause the processor to perform processes including:

raising the first stopper, when the belt conveys the platen after raising the second stopper.

6. The pretreatment apparatus according to claim 2, wherein the staying area includes a first staying area and a second staying area, the second staying area is adjacent to the first staying area and receives the platen from a previous process, and the pretreatment apparatus further comprises:

a processor; and a memory storing computer-readable instructions that, when executed by the processor, cause the processor to perform processes including:

determining whether there is an empty space for the platen to stay in the first staying area; and conveying the platen from the second staying area to the first staying area when it is determined that there is the empty space in the first staying area.

7. The pretreatment apparatus according to claim 6, wherein the pretreatment portion includes a heat processing portion, and the memory further stores computer-readable instructions that, when executed by the processor, cause the processor to perform processes including:

determining whether the platen is to be caused to stay in the second staying area; and causing the platen to stay in the second staying area for a certain period of time so as to cool the platen, when it is determined that the platen is to be caused to stay in the second staying area.

8. The pretreatment apparatus according to claim 2, further comprising:

a set position sensor configured to detect the platen at the set position; and a staying area sensor configured to detect the platen in the staying area, wherein the belt conveys the platen from the staying area to the set position when a state changes from a state of detecting the platen by the set position sensor to a state of not detecting the platen by the set position sensor.

9. The pretreatment apparatus according to the claim 1, wherein the belt includes a set position belt and a staying area belt, and the staying area belt conveys the platen toward the set position after the set position belt conveys the platen.

10. The pretreatment apparatus according to claim 1, further comprising:

a receiver configured to receive an instruction to start conveying the platen at the set position toward the pretreatment portion, wherein the belt conveys the platen at the set position when the receiver receives the instruction.

11. The pretreatment apparatus according to claim 1, further comprises:

a processor; and a memory storing computer-readable instructions that, when executed by the processor, cause the processor to perform processes including:

determining whether an error command has been received; and executing error processing when it is determined that the error command has been received.

12. The pretreatment apparatus according to claim 1, further comprising:

a platen fixing portion configured to fix the platen at the set position.

13. The pretreatment apparatus according to claim 1, wherein the pretreatment portion includes an application portion and a heat processing portion, the application portion is configured to apply a pretreatment agent to a fabric set on the platen, and the heat processing portion is configured to perform heat processing on the fabric set on the platen.

14. The pretreatment apparatus according to claim 1, wherein the pretreatment portion includes a heat press portion comprising:

an air passage member defining a passage for air;

an air supply source connected to the air passage member;

a first valve connected downstream of the air supply source via the air passage member, the first valve being configured to be switchable between an open state and a closed state;

a second valve connected downstream of the first valve via the air passage member, the second valve being configured to be switchable between the open state and the closed state;

an air cylinder connected downstream of the second valve via the air passage member; and a third valve connected downstream of the air cylinder via the air passage member, the third valve being configured to be switchable between the open state and the closed state.

15. The pretreatment apparatus according to claim 14, wherein the heat press portion further comprises a pressure transducer connected to the air passage member between the first valve and the second valve, the pressure transducer being configured to output a pressure signal corresponding to air pressure in the air passage member between the first valve and the second valve, wherein the pretreatment apparatus according further comprises:

a processor; and a memory storing computer-readable instructions that, when executed by the processor, cause the processor to perform processes including:

controlling, when the first valve, the second valve, and the third valve are in the closed state, the first valve to be in the open state;

monitoring the pressure signal from the pressure transducer; and controlling, in response to receiving the pressure signal indicating a predetermined pressure, the first valve to be in the closed state.

16. The pretreatment apparatus according to claim 15, wherein the heat press portion further comprises a downstream sensor located downstream of the air cylinder in a conveying path of the platen, the downstream sensor being configured to detect the platen, wherein the memory further stores computer-readable instructions that, when executed by the processor, cause the processor to perform processes including:

controlling, in response to receiving a detection signal from the downstream sensor, the second valve to be in the open state.

17. The pretreatment apparatus according to claim 16, wherein the memory further stores computer-readable instructions that, when executed by the processor, cause the processor to perform processes including:

controlling, after controlling the second valve to be in the open state, the second valve to be in the closed state; and controlling the first valve to be in the open state after controlling the second valve to be in the closed state.

* * * * *